US008471495B2

(12) United States Patent
Muguruma et al.

(10) Patent No.: US 8,471,495 B2
(45) Date of Patent: Jun. 25, 2013

(54) LIGHT-EMITTING DIODE DRIVING APPARATUS AND LIGHT-EMITTING DIODE LIGHTING CONTROLLING METHOD

(75) Inventors: Shuji Muguruma, Anan (JP); Wataru Ogura, Okaya (JP); Teruo Watanabe, Okaya (JP)

(73) Assignee: Nichia Corporation, Anan-shi (JP)

( * ) Notice: Subject to any disclaimer, the term of this patent is extended or adjusted under 35 U.S.C. 154(b) by 259 days.

(21) Appl. No.: 12/873,238

(22) Filed: Aug. 31, 2010

(65) Prior Publication Data

US 2011/0199003 A1 Aug. 18, 2011

(30) Foreign Application Priority Data

Nov. 13, 2009 (JP) ..... 2009-260505

(51) Int. Cl.
*H05B 37/02* (2006.01)

(52) U.S. Cl.
USPC ..... 315/299; 315/185 R; 315/210; 315/308

(58) Field of Classification Search
USPC ..... 315/185 R, 209 R, 210, 224, 291, 315/299, 307, 308
See application file for complete search history.

(56) References Cited

U.S. PATENT DOCUMENTS

| | | | | |
|---|---|---|---|---|
| 7,800,316 | B2 * | 9/2010 | Haug | 315/299 |
| 7,986,107 | B2 * | 7/2011 | Weaver et al. | 315/291 |
| 8,174,212 | B2 * | 5/2012 | Tziony et al. | 315/309 |
| 2011/0109244 | A1 * | 5/2011 | Grajcar | 315/294 |

FOREIGN PATENT DOCUMENTS

| | | |
|---|---|---|
| JP | 2006-147933 | 6/2006 |
| JP | 2006-244848 | 9/2006 |
| JP | 2009-134933 | 6/2009 |
| JP | 2010-135473 | 6/2010 |

OTHER PUBLICATIONS

International Search Report for corresponding International Application No. PCT/JP2010/064791, Nov. 16, 2010.

* cited by examiner

*Primary Examiner* — Thuy Vinh Tran
(74) *Attorney, Agent, or Firm* — Ditthavong Mori & Steiner, P.C.

(57) ABSTRACT

A LED driving apparatus includes a rectifying circuit, first, second and third blocks, and first and second switching portions. The rectifying circuit is connected to AC power supply, and rectifies AC voltage of the AC power supply to provide pulsating current voltage. Each block includes a plurality of LEDs. The first, second and third blocks are serially connected to the output side of the rectifying circuit. The first switching portion switches ON/OFF of a first bypass path based on flowing current amount in the first block. The first bypass path bypasses the second block. The second switching portion switches ON/OFF of a second bypass path based on flowing current amount in the first and second blocks. The second bypass path bypasses the third block.

10 Claims, 16 Drawing Sheets

LIGHT-EMITTING DIODE DRIVING APPARATUS AND LIGHT-EMITTING DIODE LIGHTING CONTROLLING METHOD

BACKGROUND OF THE INVENTION

1. Field of the Invention

The present invention relates to a light-emitting diode driving apparatus and a light-emitting diode driving operation controlling method, and in particular to a light-emitting diode driving apparatus and a light-emitting diode driving operation controlling method using AC power supply.

2. Description of the Related Art

In recent years, significant attention is given to light-emitting diodes (hereinafter, occasionally referred to as "LEDs") as lighting sources. The reason is that LEDs can be driven at low power consumption as compared with filament lamps or fluorescent lamps. LEDs are small, and have shock resistance. In addition, LEDs are less prone to burn out. Thus, LEDs have these advantages.

In the case of lighting sources, it is desirable that AC power such as commercial power for home use is used as power supply for lighting sources. LEDs are devices driven by DC power. LEDs emit light only when applied with a current in the forward direction. Also, in the case of LEDs that are currently typically used for lighting use, the LEDs operate on DC power at a forward directional voltage Vf of about 3.5 V. LEDs do not emit light if a voltage applied to the LEDs does not reach Vf. Conversely, a voltage applied to the LEDs exceeds Vf, an excessive amount of current will flow through the LEDs. Accordingly, it can be said that DC power is suitable for driving LEDs.

To satisfy the contradictory conditions, various types of LED driving circuits have been proposed that use AC power. For example, in a driving circuit shown in FIG. 8, after an AC voltage of an AC power supply 71 is subjected to full-wave rectification in a bridge circuit 72, and is then smoothed by a smoothing capacitor 73, an LED group 75 is driven by a driving circuit 74 consisting of a constant current circuit, a switching power supply circuit and the like. In this circuit, since the smoothing capacitor 73 is required to have a high voltage resistance and a high capacitance, this circuit necessarily has a large element such as aluminum electrolytic capacitor. Also, generally, the life of electrolytic capacitors will be short, in the case where the ambient temperature is high. A coil used in the switching power supply also will be large and deteriorate under high temperature condition. Since the switching power supply circuit switches very quickly between full-on and full-off states at a large amount of current, noise is likely to be generated. Accordingly, noise control measures are required. For this reason, this driving circuit is required to prepare space for elements of the driving circuit for driving LEDs, which could be essentially suitable for size reduction. In addition, this driving circuit is required to have a temperature shielding structure and noise control measures.

To address these problems, driving methods are devised that drive LEDs by using a constant current circuit or the like without smoothing a voltage waveform rectified by the bridge circuit. FIG. 9 shows a circuit diagram of this type of circuit. In this illustrated drive circuit, after an AC voltage of an AC power supply 81 is subjected to full-wave rectification in a bridge circuit 82 similarly to FIG. 8, an LED group 85 is driven by a constant current circuit 84 consisting of transistors and resistors without smoothing. The constant current circuit 84 consists of a feedback resistor 86, a current detection transistor 87, a current control transistor 88, and a current detection resistor 89. Since this circuit consists of semiconductor elements, this circuit can operate in the same operating temperature range as LEDs, which are also semiconductor device. Accordingly, it can be said that this circuit is suitable for size reduction.

However, in the case where LEDs are driven without smoothing, the voltage of waveform is not fixed but periodically varies as shown in FIG. 10. LEDs are connected to each other in series as shown in FIG. 9. Accordingly, the LEDs do not emit light as long as a voltage applied to the LEDs exceeds the total value of the forward directional voltages Vf of the LEDs. For this reason, in the case of a voltage waveform that varies in accordance with time, the emission time of the LEDs is limited. As a result, the operation efficiency of LED decreases. Here, the operation efficiency of LED refers to a value represented by (effective power consumption of LED)/(power consumption of LED when driven at DC rating).

In particular, in the case of a circuit that includes a current restriction resistor connected to an LED in series to protect the LED, the electric power of the LED also sharply varies in accordance with power supply voltage variation. Considering that, in some cases, a current flowing through the LED may exceed the current rating of the LED, it is necessary to previously adjust a current flowing through the LED to a smaller value. For this reason, in this case, a constant current circuit is typically incorporated to drive the LED. In more detail, in this case, for example, since the effective value of commercial power is 100 V in Japan, the maximum voltage after full-wave rectification is 141V. In the case where an LED(s) is/are connected to this power supply through the constant current circuit and driven by the constant current circuit, when only one LED with Vf=3.5 V is connected to this power supply through the constant current circuit and driven by the constant current circuit, the LED is turned ON in a range where the power supply voltage exceeds 3.5V. Accordingly, the LED operation efficiency will be high. However, as shown by shaded areas in the voltage waveform in FIG. 11, most of electric power will be consumed to generate heat, and as a result is not used for light emission. Accordingly, power supply efficiency will greatly decrease.

Also, it is conceivable that a plurality of LEDs are connected in series to this power supply so that the number of connected LEDs is increased whereby adjusting the total value of the forward directional voltages Vf to a value near 141 V. In this case, if the power supply efficiency is adjusted to about 90%, a Vf total value of about 120 V is required. However, in this configuration, the LEDs are turned ON only when the power supply voltage exceeds 120 V. The LEDs do not emit light in a range in that the power supply voltage does not reach 120 V. Accordingly, the LEDs only emit light in ranges shown by dashed lines in FIG. 11. As a result, the ON duty of this configuration will be only about 35%. For this reason, the LED operation efficiency also will be only about 35%, and the power factor will be only about 77%. As discussed above, if the Vf total value is adjusted small to increase the LED operation efficiency, power will be wasted to generate heat. Conversely, if the Vf total value is adjusted large to improve the power supply efficiency, the LED ON-duty will be small. As a result, the LED operation efficiency decreases. These requirements are contradictory to each other.

A method has been proposed that switches LEDs so that a Vf total value is changed in accordance with a varying voltage value (see Japanese Patent Laid-Open Publication No. 2006-147933). In this method, a number of LEDs connected to each other in series are divided into blocks 61, 62, 63, 64, 65 and 66 as shown in a circuit diagram of FIG. 12. The LED blocks 61 to 66 are selectively connected to the power supply in accordance with the voltage value of input voltage of rectified waveform by a switch controlling portion 67 consisting of a microcomputer so that a Vf total value is changed in a stepped manner. As a result, as shown by a voltage waveform in a timing chart of FIG. 13, since the LEDs can be driven by a plurality of rectangular waves corresponding to the rectified waveform, the LED operation efficiency can be improved as compared with the ON-duty in the case of only single rectangular wave shown in FIG. 11. However, in this method, since the microcomputer is used to select connect the LED block based on the result of a detected voltage value of input waveform, complicated control is available but the circuit configuration becomes expensive. For this reason, this method is not suitable for inexpensive lighting apparatuses.

Also, an apparatus has been proposed that detects a voltage by Zener diodes and resistors without a microcomputer as shown in a circuit diagram of FIG. 14. In this illustrated circuit, LED blocks 91, 92 and 93 are selectively connected to the power supply in accordance with a voltage value of input voltage of rectified waveform based on a voltage value obtained by dividing a power supply voltage by Zener diodes 94 and resistors 95 so that a Vf total value is changed in a stepped manner. As a result, LEDs can be driven by a plurality of rectangular waves corresponding to the rectified waveform as shown by voltage waveforms in FIG. 15. This apparatus can be configured inexpensive as compared with the circuit configuration shown in FIG. 12.

However, in the aforementioned both proposals, since the LED blocks are selectively driven in accordance with a rectified input voltage, the threshold voltage value is required to accurately match with a total Vf value of each LED block (at a specified current). Generally, LED devices have property deviation. LED devices have Vf values and temperature characteristics different from each other. For this reason, it is very difficult to accurately adjust a total Vf value of each LED block in fact. In particular, since a plurality of LED devices are necessarily connected to each other in series in each LED block as shown in FIG. 13, deviated Vf values of the devices are summed. As a result, a total deviated Vf value of the entire LED block will be further increased. Although it is conceivable that only previously sorted LED device are used to suppress the deviation, this may increase costs of LED devices and deteriorate yields of LED devices. In particular, a number of LED devices are used in a lighting apparatus. Accordingly, cost reduction of LEDs is strongly required to spread the use of LED lighting apparatus. For this reason, such LED device sorting is not actually available.

In the case where a Vf total value of an LED block deviates from the desired value, if the Vf total value is higher than the threshold voltage value, even when LEDs in the LED block are selectively connected to the power voltage, the LEDs cannot emit light. This causes noise generation and power factor reduction. Conversely, in a Vf total value of LEDs is lower than the threshold voltage value, a corresponding excess amount of power will be wasted in the constant current circuit. For this reason, because of LED device deviation, it is difficult to provide desired LED device operation. As a result, selective light emission delay may occur and the efficiency may decrease. Accordingly, in fact, it is difficult to realize selective light emission in terms of LED light emission quality and reliability.

In the aforementioned method, although the LEDs can be driven by a plurality of rectangular waves by selectively connecting the LED blocks to the power supply, power is still wasted as shown by diagonally shaded areas in FIG. 15. For this reason, the efficiency of the aforementioned method is still poor.

In particular, although LEDs can essentially emit light at the highest intensity in a part where the highest voltage is applied in the area. However, such a range is not effectively used.

SUMMARY OF THE INVENTION

The present invention is devised to solve the above problems. It is a main object to provide a light-emitting diode driving apparatus and a light-emitting diode driving operation controlling method capable of improving the operation efficiency and power factor of LEDs while maintaining high power supply efficiency, and additionally of smoothing out deviation of forward directional voltages Vf and temperature characteristics of LEDs to be used whereby allowing the LEDs to stably operate.

To achieve the above object, a light-emitting diode driving apparatus according to a first aspect of the present invention can include a rectifying circuit 2, first, second and third LED blocks 11, 12 and 13, and a first and second switching portions. The rectifying circuit 2 can be connected to AC power supply, and rectifies an AC voltage of the AC power supply to provide a pulsating voltage. Each of the first, second and third LED blocks 11, 12 and 13 includes a plurality of light-emitting diodes, and is connected to the output side of the rectifying circuit 2 in series. The first switching portion switches ON/OFF of a first bypass path BP1 based on a flowing current amount in the first LED block 11. The first bypass path BP1 bypasses the second LED block 12. The second switching portion switches ON/OFF of a second bypass path BP2 based on a flowing current amount in the first and second LED blocks 11 and 12. The second bypass path BP2 bypasses the third LED block 13. According to this light-emitting diode driving apparatus, since the LED block(s) applied with a flowing current amount can be selected based on a flowing current amount in the LED block(s), it is possible to efficiently use electric power irrespective of pulsating current voltage variation, and therefore to improve the LED operation efficiency and the power factor of the light-emitting diode driving apparatus.

In addition, in a light-emitting diode driving apparatus according to a second aspect of the present invention, the first switching portion can include a first current controlling portion 21, a first current detecting/controlling portion 31 and a first current detecting portion 4B, and the second switching portion can include a second current controlling portion 22, a second current detecting/controlling portion 32 and a second current detecting portion 4C. The first current controlling portion 21 is connected to the second LED block 12 in parallel, and restricts a flowing current amount in the first LED block 11. The first current detecting/controlling portion 31 controls the restriction amount on a flowing current in the first LED block 11 by the first current controlling portion 21. The first current detecting portion 4B is connected to the first LED block 11 in series, and detects a flowing current amount in the first LED block 11. The second current controlling portion 22 is connected to the third LED block 13 in parallel, and restricts a flowing current amount in the first and second LED blocks 11 and 12. The second current detecting/controlling portion 32 controls the restriction amount on a flowing current in the first and second LED blocks 11 and 12 by the second current controlling portion 22. The second current detecting portion 4C is connected to the second LED block 12 in series, and detects a flowing current amount in the second LED block 12. According to this light-emitting diode driving apparatus, since a flowing current amount in each LED block, i.e., ON/OFF of each LED block can be switched by the current controlling portions and the current detecting/controlling portions based on a flowing current amount in the LED block, it is possible to efficiently use electric power irrespective of pulsating current voltage variation, and therefore to improve the LED operation efficiency and the power factor of the light-emitting diode driving apparatus.

In addition, in a light-emitting diode driving apparatus according to a third aspect of the present invention, first and second current detecting portions 4B and 4C are configured by a single element. According to this light-emitting diode driving apparatus, since first and second current detecting/controlling portions can control the flowing current amounts in the LED blocks and the current controlling portion based on a common flowing current amount, dedicated current detecting portions are not required to be separately provided. Therefore, the circuit configuration of the light-emitting diode driving apparatus can be simple.

Also, a light-emitting diode driving apparatus according to a fourth aspect of the present invention can include a rectifying circuit, first to third LED blocks, a current restricting portion, first to third current controlling portions, and first to third current detecting/controlling portions. The rectifying circuit can be connected to AC power supply, and rectifies an AC voltage of the AC power supply to provide a pulsating current voltage. The first LED block includes a plurality of light-emitting diodes, and is connected to the output side of the rectifying circuit in series. The second LED block includes a plurality of light-emitting diodes, and is connected to the first LED block in series. The third LED block includes a plurality of light-emitting diodes, and is connected to the second LED block in series. The current restricting portion is connected to the third LED block in series. The first current controlling portion is connected to the second LED block in parallel, and restricts a flowing current amount in the first LED block. The second current controlling portion is connected to the third LED block in parallel, and restricts a flowing current amount in the first and second LED blocks. The third current controlling portion is connected to the current restricting portion in parallel, and restricts a flowing current amount in the first, second and third LED blocks. The first current detecting/controlling portion controls the restriction amount on a flowing current in the first LED block by the first current controlling portion. The second current detecting/controlling portion controls the restriction amount on a flowing current in the first and second LED blocks by the second current controlling portion. The third current detecting/controlling portion controls the restriction amount on a flowing current in the first, second and third LED blocks by the third current controlling portion. According to this light-emitting diode driving apparatus, since a flowing current amount in the LED block(s), i.e., ON/OFF of the LED block(s) can be switched based on a flowing current amount in each LED block, it is possible to efficiently use electric power irrespective of pulsating current voltage variation, and therefore to improve the LED operation efficiency and the power factor of the light-emitting diode driving apparatus. Also, since light emission of LED is controlled by current control, it is possible to provide optimum operation independent from deviation of the forward directional voltages Vf and the temperature characteristics of LED devices. Also, since complicated control is not required, the circuit configuration of the apparatus can be simple. Therefore, it is possible to provide an inexpensive but reliable LED driving apparatus. In addition, it is possible to suppress noise generation.

In addition, in a light-emitting diode driving apparatus according to a fifth aspect of the present invention, the restriction amount on a flowing current in the first LED block by the first current controlling portion can be smaller than the restriction amount on a flowing current in the first and second LED blocks by the second current controlling portion, and the restriction amount on a flowing current in the first and second LED blocks by the second current controlling portion can be smaller than the restriction amount on a flowing current in the first, second and third LED blocks by the third current controlling portion. Accordingly, the LED blocks can be sequentially switched ON so that the first, second and third LED blocks are switched ON one by one. In addition, since the LED block flowing current value can be suppressed in an LED block that emits light for longer time, it is possible to suppress heat generation amount. As a result, the life of light-emitting diode device can be improved.

In addition, a light-emitting diode driving apparatus according to a sixth aspect of the present invention further can include a current detecting portion that is connected between the current restricting portion and the ground, and additionally the first, second and third current detecting/controlling portions can control the restriction amounts on flowing currents in the first, second and third LED blocks based on a flowing current amount in the current detecting portion. According to this light-emitting diode driving apparatus, since these current detecting/controlling portions can control a flowing current amount in the LED blocks and the current controlling portion based on a common flowing current amount, dedicated current detecting portions are not required to be separately provided. Therefore, the circuit configuration of the light-emitting diode driving apparatus can be simple.

In addition, a light-emitting diode driving apparatus according to a seventh aspect of the present invention further can include a capacitor that is connected between the ground and the output side of the rectifying circuit. This light-emitting diode driving apparatus can prevent that all the light-emitting diodes are turned OFF in a low pulsating current voltage range, in other words, can prevent so-called stroboscopic effect.

A light-emitting diode driving operation controlling method according to an eighth aspect of the present invention can include steps of providing a pulsating current voltage, applying the pulsating current voltage to first, second and third LED blocks, switching ON/OFF of a first bypass path based on a flowing current amount in the first LED block by a first current controlling portion, and switching ON/OFF of a second bypass path based on a flowing current amount in the second LED block by a second current controlling portion. In the step of providing a pulsating current voltage, the pulsating current voltage is obtained by rectifying an AC voltage of AC power supply. In the step of applying the pulsating current voltage to first, second and third LED blocks, each of the first, second and third LED blocks includes a plurality of light-emitting diodes that are connected to each other in series, and the first, second and third LED blocks are connected to each other in series. In the step of switching ON/OFF of a first bypass path based on a flowing current amount in the first LED block by a first switching portion, the first bypass path is turned ON when a flowing current amount is not higher than a predetermined value, and the first bypass path is turned OFF when this flowing current amount exceeds this predetermined value. The first switching portion can switch ON/OFF of the first bypass path connected to the second LED block in parallel for bypassing the second LED block. In the step of switching ON/OFF of a second bypass path based on a flowing current amount in the second LED block by a second switching portion, the second bypass path is turned ON when a flowing current amount is not higher than a predetermined value, and the second bypass path is turned OFF when this flowing current amount exceeds this predetermined value. The second switching portion can switch ON/OFF of the second bypass path connected to the third LED block in parallel for bypassing the third LED block if the first bypass path is turned OFF so that a current can flows through the second LED block. According to this light-emitting diode driving operation controlling method, since a flowing current amount in the LED block(s), i.e., ON/OFF of the LED block(s) can be switched based on a flowing current amount in each LED block, it is possible to efficiently use electric power irrespective of pulsating current voltage variation, and therefore to improve the LED operation efficiency and the power factor of the light-emitting diode driving operation controlling method. Also, since ON/OFF of LED is controlled by current control, it is possible to provide optimum operation independent from deviation of the forward directional voltages Vf and the temperature characteristics of LED devices. Also, since complicated control is not required, the circuit configuration of the apparatus can be simple. Therefore, it is possible to provide an inexpensive but reliable LED driving apparatus. In addition, it is possible to suppress noise generation.

A light-emitting diode driving operation controlling method according to a ninth aspect of the present invention can further include a step of switching ON/OFF of a third bypass path based on a flowing current amount in the third LED block by a third switching portion so that the third bypass path is turned ON when this flowing current amount is not higher than a predetermined value and the third bypass path is turned OFF when this flowing current amount exceeds this predetermined value. The third current controlling portion can switch ON/OFF of the third bypass path connected in parallel to a current restricting portion connected in series to the third LED block for bypassing the current restricting portion if the second bypass path is turned OFF so that a current can flow through the third LED block.

The above and further objects of the present invention as well as the features thereof will become more apparent from the following detailed description to be made in conjunction with the accompanying drawings.

DETAILED DESCRIPTION OF THE EMBODIMENT(S)

The following description will describe embodiments according to the present invention with reference to the drawings.

Figure 1:
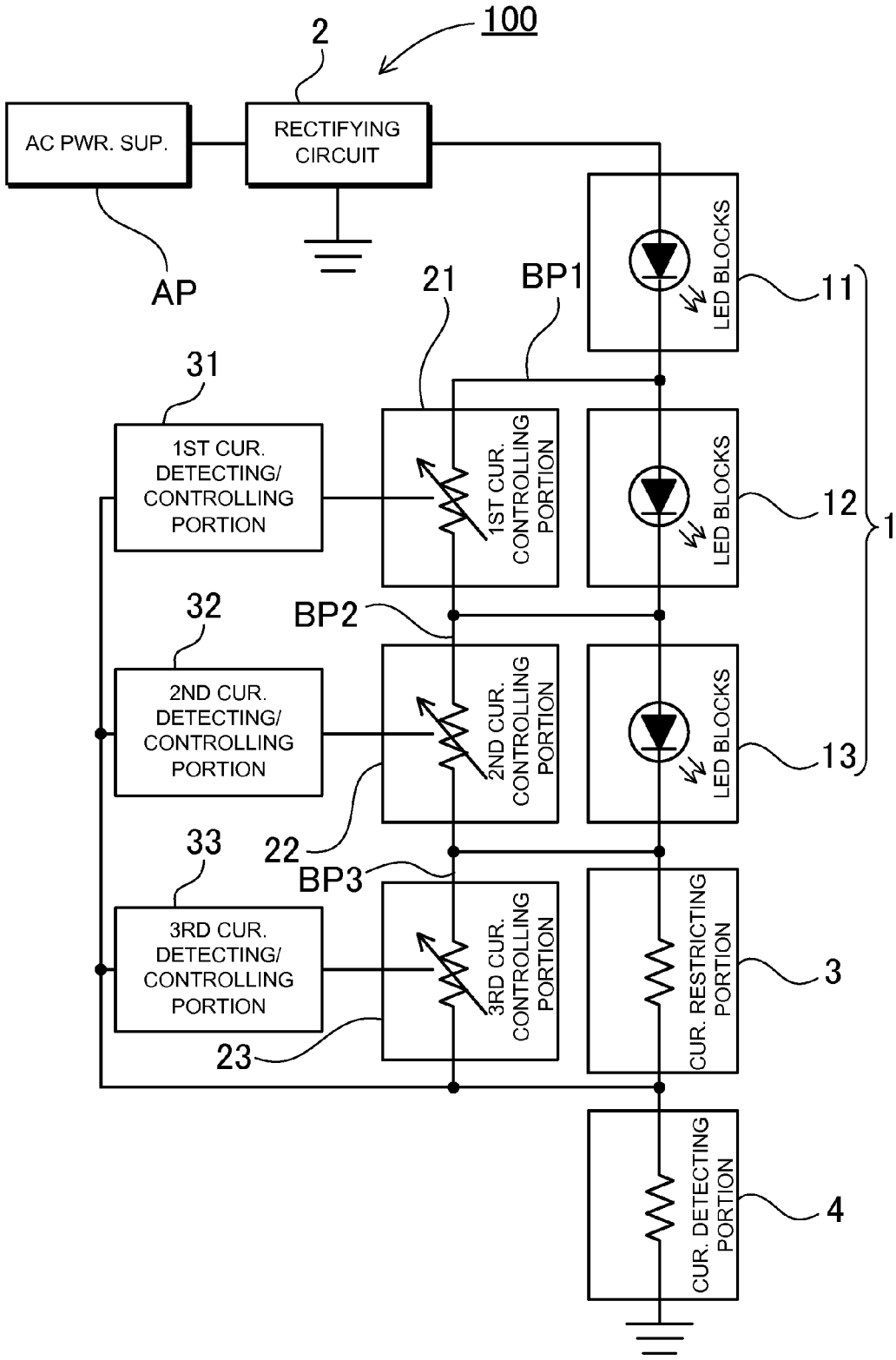
FIG. 1 is a block diagram showing a light-emitting diode driving apparatus according to a first embodiment.

FIG. 1 is a block diagram showing a light-emitting diode driving apparatus 100 according to an embodiment. This illustrated light-emitting diode driving apparatus 100 is connected to AC power supply AP, and includes a rectifying circuit 2, an LED block group 1, a current restricting portion 3 and a current detecting portion 4. The rectifying circuit 2 provides a pulsating current voltage by rectifying an AC voltage. The LED block group 1 includes a plurality of LED blocks. The rectifying circuit 2, the LED block group 1, the current restricting portion 3 and the current detecting portion 4 are connected to each other in series. In this embodiment, the LED blocks are three LED blocks of first, second and third LED blocks 11, 12 and 13 that are connected to each other in series. Thus, the first, second and third LED blocks 11, 12 and 13 compose the LED block group 1. Needless to say, it should be appreciated that connection of elements "in series" does not limit the connection order of the elements except when specified otherwise, and includes connection of the elements that interpose an additional element between them as long as the elements are connected to each other in series. For example, the first LED block 11, the second LED block 12, the third LED block 13, the current restricting portion 3 and the current detecting portion 4 can be connected to each other in this order. In addition to this, the first LED block 11, the second LED block 12, the current detecting portion 4, the third LED block 13 and the current restricting portion 3 can be connected to each other in this order. Also, connection of elements in series includes the connection where a plurality of LED devices that compose the first LED block as discussed later is interposed between other elements, for example, between the second and third LED blocks.

Each of the current controlling portions is connected to the both ends of each of the second LED block 12, the third LED block 13 and the current restricting portion 3. Since the current controlling portion is connected to each of the second LED block 12, the third LED block 13 or the current restricting portion 3 in parallel, the current controlling portion serves as a bypass path. In other words, each current controlling portion can adjust the amount of a bypassed current, which in turn can restrict a flowing current amount in the LED block(s). In the case of FIG. 1, the first current controlling portion 21 is connected in parallel to the second LED block 12, and serves as a first bypass path BP1. Also, the second current controlling portion 22 is connected in parallel to the third LED block 13, and serves as a second bypass path BP2. Also, the third current controlling portion 23 is connected in parallel to the current restricting portion 3, and serves as a third bypass path BP3.

In the case of FIG. 1, a resistor as an LED-current restricting resistor is employed as the current restricting portion 3, and also serves as a protection resistor for LEDs. Also, the current detecting portion 4 can be a resistor. This current detecting portion 4 detects a flowing current in the LED block group 1 of serially-connected LED blocks based on voltage drop or the like. Thus, the LED devices that compose LED blocks are driven at a constant current. Current detecting/controlling portions for controlling a constant current circuit are provided to drive LED devices at a constant current. In this exemplary circuit, the current controlling portions and the current detecting/controlling portions are composed of a kind of constant current circuit.

The current detecting/controlling portions are connected to the current controlling portion, and control operation of the current controlling portion. The current controlling portion is switched ON/OFF, and continuously changes a current amount based on the control by the current detecting/controlling portions. Specifically, first, second and third current detecting/controlling portions 31, 32 and 33 are provided to control operation of the first, second and third current controlling portions 21, 22 and 23, respectively. Each current detecting/controlling portion monitors a current amount in LEDs, and adjusts the control amount by the current controlling portion based on the monitored value.

Each LED block includes a plurality of LED devices that are connected to each other in series and/or in parallel. Surface mount device (SMD) type LEDs or bullet type LEDs can be suitably used as the LED devices. SMD type LED devices can have packages with various external shapes, such as a rectangular shape in plan view, depending on applications. Needless to say, a plurality of LED devices can be connected to each other in series and/or in parallel inside an LED package as the LED block.

A subtotal forward directional voltage of LED devices that are included in an LED block is defined by the sum of the forward directional voltages of the LED devices that are included the an LED block. A subtotal forward directional voltage is determined by the number of the LED devices that are connected to each other in series in an LED block. For example, in the case where eight LED devices are employed that have a forward directional voltage of 3.6 V, the subtotal forward directional voltage of the eight LED devices will be $3.6\times8=28.8$ V. However, since LED devices have property deviation, generally their subtotal forward directional voltage obtained by the sum of their forward directional voltages is not fixed. For this reason, the subtotal forward directional voltages of the LED blocks also have deviation.

The light-emitting diode driving apparatus 100 switches ON/constant current control/OFF of each LED block based on a current value detected by the current detecting portion 4. In other words, a current is controlled not based on the voltage value of rectification voltage but based on an amount of an actually-flowing current. For this reason, ON/constant current control/OFF of the LED blocks can be accurately switched at appropriate timing irrespective of deviation of the forward directional voltages of LED devices. Therefore, reliable and stable operation is expected.

Specifically, in the case of FIG. 1, the first current detecting/controlling portion 31 controls the restriction amount on a flowing current in the first LED block 11 by the first current controlling portion 21 based on a flowing current amount in the first LED block 11. Specifically, when a flowing current amount in the first LED block 11 is higher than a predetermined first threshold current value, the first current detecting/controlling portion 31 turns the second LED block 12 ON and drives the second LED block 12 at a constant current. When a flowing current amount in the first LED block 11 is lower than the first threshold current value, the first current detecting/controlling portion 31 turns the second LED block 12 OFF. Also, the second current detecting/controlling portion 32 controls the restriction amount on a flowing current in the second LED block 12 by the second current controlling portion 22 based on a flowing current amount in the second LED block 12. The second current detecting/controlling portion 32 switches ON/constant current control/OFF of the second LED block 12 with reference to a predetermined second threshold current value. Similarly, the third current detecting/controlling portion 33 controls the restriction amount on a flowing current in the third LED block 13 by the third current controlling portion 23 based on a flowing current amount in the third LED block 13. The third current detecting/controlling portion 33 switches ON/constant current control/OFF of the third LED block 13 with reference to a predetermined third threshold current value.

In the case where the threshold current values are specified first threshold current value<second threshold current value<third threshold current value, the first LED block 11, the second LED block 12, the third LED block 13 and the current restricting portion 3 can be turned ON/constant current control/OFF in this order.

The light-emitting diode driving apparatus using AC power such as commercial power for home use includes a plurality of constant current circuits that drive an appropriate number of serially-connected LED devices in accordance with a periodically-varying pulsating current voltage that is obtained after an alternating current is subjected to full-wave rectification. Thus, the constant current circuits can appropriately drive the LED current detecting circuits.

The light-emitting diode driving apparatus applies a first current value to the first LED block 11, a second current value larger than the first current value to the first and second LED blocks 11 and 12, and a third current value larger than the second current value to the first, second and third LED blocks 11, 12 and 13. In particular, since a flowing current amount in the LED block(s) is controlled in a constant current control manner, the LED block can be switched ON/constant current control/OFF in accordance with this flowing current amount. Therefore, the LEDs can be efficiently driven by a pulsating current voltage.

Each LED block is composed of a plurality of light-emitting diode devices connected to each other in series. Accordingly, a pulsating current voltage can be effectively divided by the light-emitting diode devices. In addition, a certain deviation of forward directional voltages Vf and the temperature characteristics of light-emitting diode devices can be smoothed out. The number of LED blocks, the number of light-emitting diode devices composing each LED block and the like can be suitably adjusted depending on required brightness, supplied voltage and the like. For example, an LED block can consist of one light-emitting diode device. The number of LED blocks can be increased so that the LED block switching transition is smoother. Conversely, the number of LED blocks can be two for simply control.

Example 1

Figure 2:
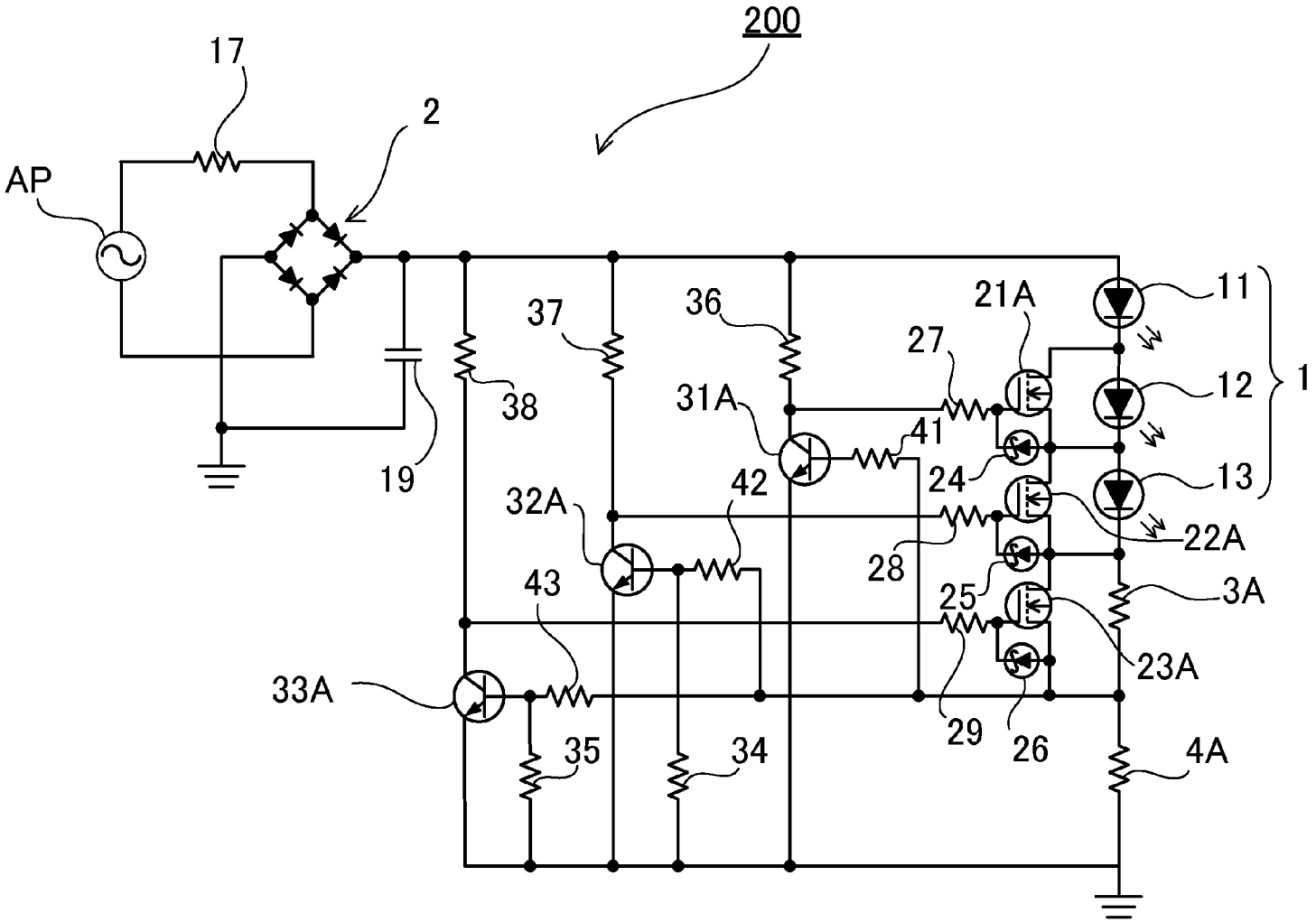
FIG. 2 is a circuit diagram showing a light-emitting diode driving apparatus according to an example 1.

FIG. 2 shows an exemplary circuit according to an example 1 that is composed of semiconductor elements to realize the configuration shown in FIG. 1. In a light-emitting diode driving apparatus 200 shown in this Figure, a diode bridge is used as the rectifying circuit 2 connected to the AC power supply AP. A protection resistor 17 is connected between the AC power supply AP and the rectifying circuit 2. A bypass capacitor 19 is connected to the output side of the rectifying circuit 2.

(AC Power Supply AP)

The 100-V commercial power can be suitably used as the AC power supply AP. The voltage 100 V in this commercial power is an effective value. The maximum voltage of a rectified waveform subjected to full-wave rectification will be about 141 V.

(LED Block)

A plurality of LEDs are divided into a plurality of LED blocks. The LED blocks are connected to each other in series. Terminals are provided between the blocks, and are connected to the current controlling portions. The LED block group 1 is composed of three blocks of first, second and third LED blocks 11, 12 and 13 in this example shown in FIG. 2. Although each LED block is indicated by one LED symbol in FIG. 2, each LED block is composed of a plurality of light-emitting diodes connected to each other in series. The number of light-emitting diodes to be connected to each other in each LED block or the number of the LED blocks to be connected to each other can be determined by the sum of forward directional voltages, i.e., the number of the LED devices connected to each other in series, and the voltage of power supply to be used. For example, in the case where the commercial power is used, a total forward directional voltage $V_{fall}$ as the sum of Vf values of the LED blocks is adjusted to about 141 V or not more than 141 V.

The three LED blocks have the same Vf value in this example shown in FIG. 2. However, the number of LED blocks is not limited to this. The number of LED blocks may be two, or four or more. Also, the Vf values of LED blocks may not be the same.

(Current Controlling Portion)

The current controlling portion serves to drive the LED block(s) at a constant current. This current controlling portion is composed of switching elements such as transistors. In particular, FETs are preferable. The reason is that saturation voltage between the source and drain of FET is substantially zero, and will not reduce a flowing current amount in the LED block. However, the current controlling portion is not limited to FETs. The current controlling portion can be composed of bipolar transistors, comparators, operational amplifiers, or variable resistors.

In this example shown in FIG. 2, FETs are employed as LED current control transistors that compose the current controlling portion. A gate protection Zener diode is connected between the gate and source terminals of each of the FETs. Specifically, first, second and third gate protection Zener diodes 24, 25 and 26 are connected between the gate and source of first, second and third LED current control transistors 21A, 22A and 23A, respectively.

A gate resistor is connected to the gate terminal of each of the LED current control transistors. Specifically, first, second and third gate resistors 27, 28 and 29 are connected to the gate terminal of the first, second and third LED current control transistors 21A, 22A and 23A, respectively. The LED current control transistors are controlled by collector voltages of current detecting transistors combined with the LED current control transistors.

In the case where the ON/OFF switching operation is controlled block by block by means of the first and second LED current control transistors 21A and 22A, the control semiconductor element such as FET, which composes an LED current control transistor for each block, is connected between the both ends of each LED block. Accordingly, the control semiconductor element is protected from exceeding its breakdown voltage by the subtotal forward directional voltage of each LED block. For this reason, advantageously, low-breakdown voltage, small semiconductor elements can be employed.

(Current Detecting/Controlling Portion)

The current detecting/controlling portion serves to allow the current controlling portion to drive the corresponding LED block at a constant current at appropriate timing. Switching elements such as transistors can be employed as the current detecting/controlling portions. In particular, bipolar transistors can be suitably employed to detect a current amount. In this example, first, second and third current detecting/controlling portions 31, 32 and 33 are composed of first, second and third current detecting transistors 31A, 32A and 33A, respectively. However, the current detecting/controlling portion is not limited to a bipolar transistor. The current detecting/controlling portion can be composed of MOSFET, comparator, operational amplifier, or variable resistor.

The current detecting/controlling portion is composed a current detecting transistor in this example shown in FIG. 2. The current detecting transistor controls operation of the corresponding LED current control transistor. In other words, the current detecting transistor is switched ON/constant current control/OFF so that the LED current control transistor is switched ON/constant current control/OFF.

An LED current detecting resistor 4A is connected to the base terminals of the current detecting transistors via base resistors. The LED current detecting resistor 4A composes the current detecting portion 4. Specifically, first, second and third base resistors 41, 42 and 43 are connected between the base terminals of the first, second and third current detecting transistors 31A, 32A and 33A, and the LED current detection resistor 4A, respectively.

Also, second and third base voltage dividing resistors 34 and 35 are connected between the base terminals of the second and third current detecting transistors 32A and 33A, and the ground, respectively. Operation of the second and third current detecting transistors is specified by their base currents, that is, by their base resistances and the resistances of the base voltage dividing resistors. Needless to say, connection to the ground (earthing, or grounding) is not limited to connection only to the so-called ground (the earth) but also to a virtual ground. For example, a metal case of a lighting apparatus can serve as a virtual ground.

The resistances of the base resistors, the base voltage dividing resistors, and the LED current detection resistor 4A specify ON/OFF timing of the current detecting transistors, in other words, determine how much amount of current turns the current detecting transistors ON/OFF. In this example, the resistances of the base resistors and the base voltage dividing resistors are designed so that the first, second and third current detecting transistors 31A, 32A and 33A are turned ON in this order.

(Threshold Current Value)

The first current detecting transistor 31A switches the first LED current control transistor 21A from ON to OFF at a first threshold current value. The second current detecting transistor 32A switches the second LED current control transistor 22A from ON to OFF at a second threshold current value. In this example, the first threshold current value is smaller than the second threshold current value. Also, the third current detecting transistor 33A switches the third LED current control transistor 23A from ON to OFF at a third threshold current value. The third threshold current value is greater than the second threshold current value. In the case of first threshold current value<second threshold current value<third threshold current value, the first, second and third LED blocks 11, 12 and 13, and the LED current restriction resistor 3A as the current restricting portions 3 are turned from OFF to ON in this order, and are turned from ON to OFF in the inverse order.

In this example, since the LED blocks and the current restricting portion 3 are connected to each other in series, the same amount of a current flows through the LED blocks and the current restricting portion 3. Thus, the LED current control transistors for the blocks are turned ON/OFF based on a flowing current amount in the LED current detection resistor 4A as the current detecting portion 4 connected to the LED blocks and the current restricting portion 3 in series.

Also, a transistor load resistor is connected to the collector terminal of each current detecting transistor. Specifically, first, second and third transistor load resistors 36, 37 and 38 are connected to the collector terminals of the first, second and third current detecting transistors 31A, 32A and 33A, respectively. The resistances of the transistor load resistors 36, 37 and 38 are specified so that the LED current control transistors 21A, 22A and 23A can be turned ON until a pulsating current voltage reaches a value in proximity to the subtotal forward directional voltage $V_{fB1}$ of the first LED block 11.

(Operation)

Figure 3:
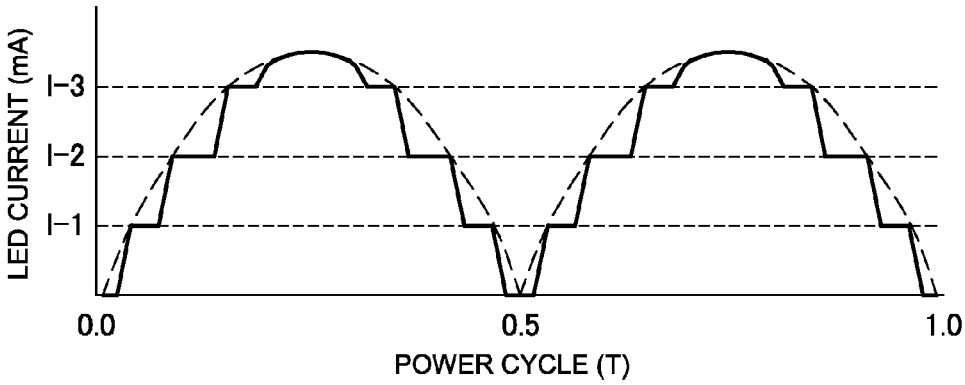
FIG. 3 shows a graph showing a current wave form in the case where a pulsating current voltage is applied to the circuit shown in FIG. 2.
Figure 10:
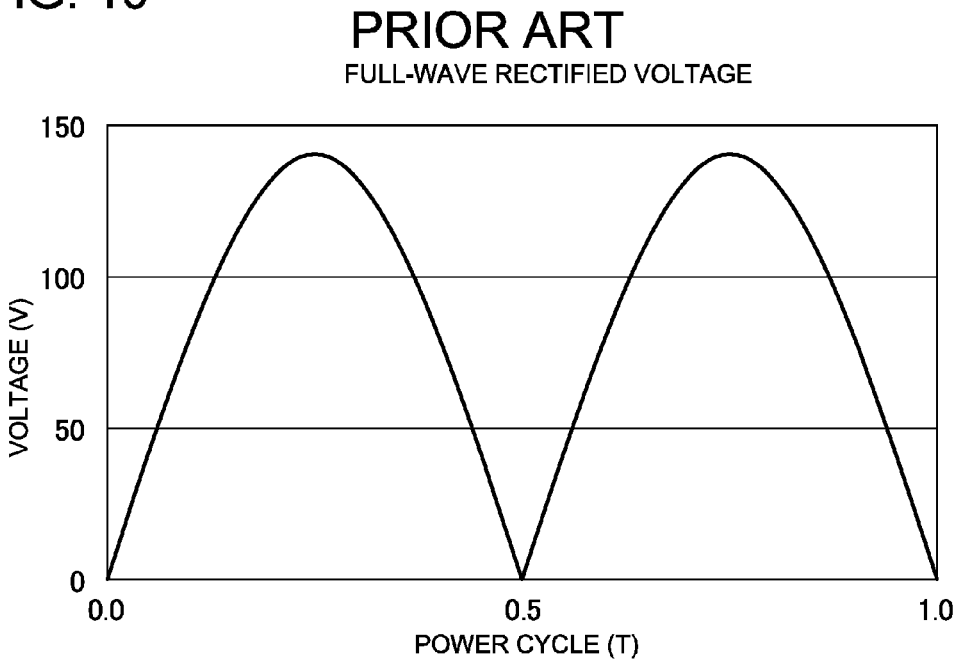
FIG. 10 shows a graph showing a waveform of a pulsating current voltage obtained by rectifying an AC voltage.
Figure 11:
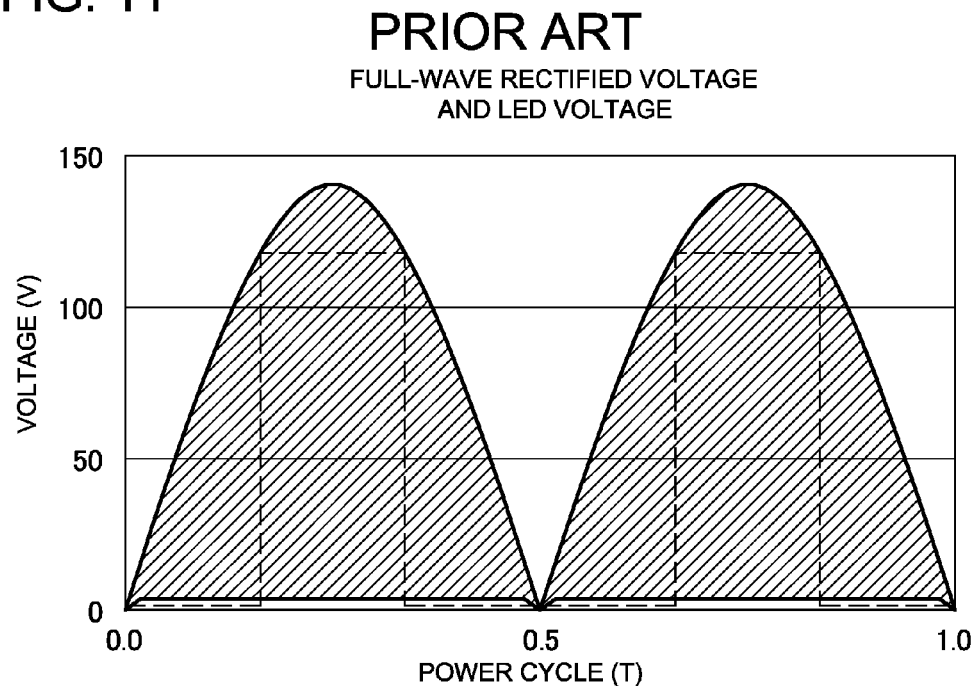
FIG. 11 shows a graph showing an LED driving voltage supplied by a full-wave rectifying power supply.
Figure 12:
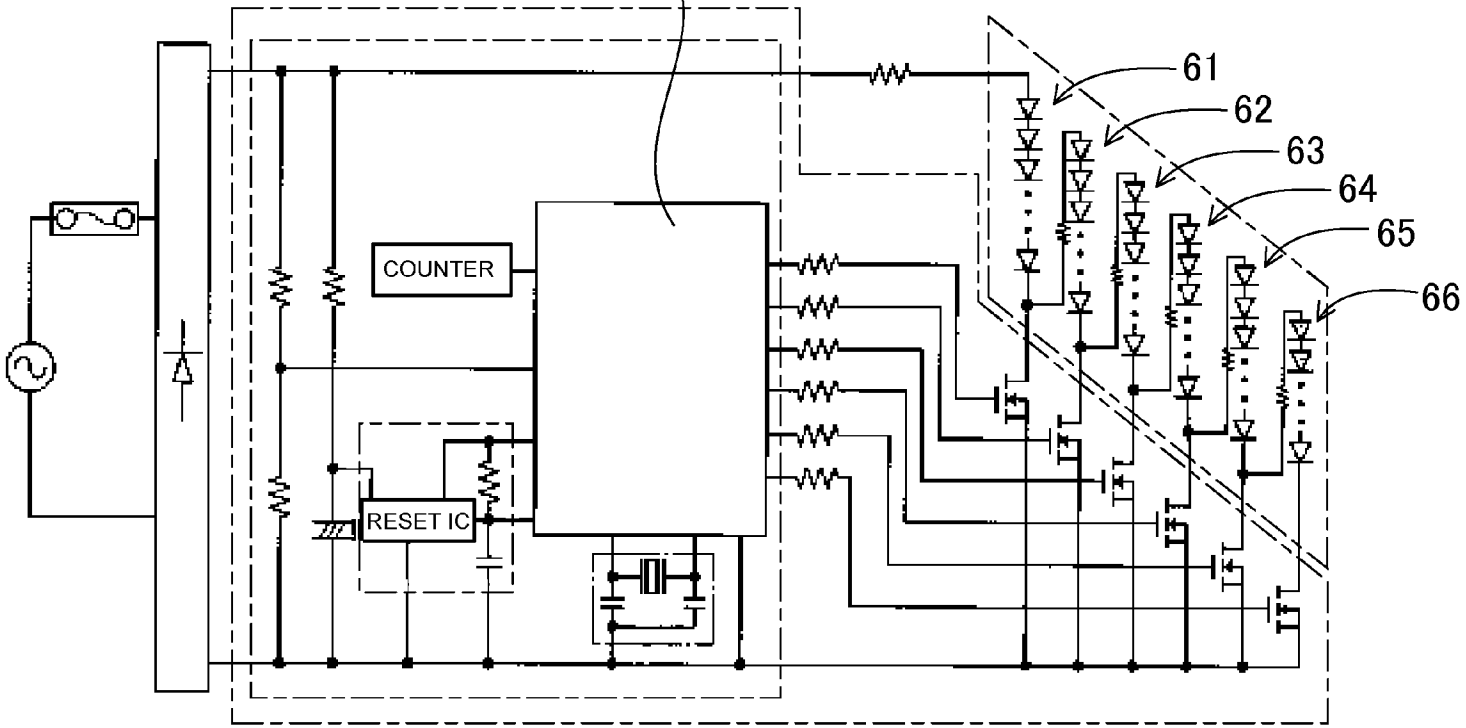
FIG. 12 PRIOR ART
FIG. 12 is a circuit diagram showing a conventional LED driving circuit that employs a microcomputer.
Figure 13:
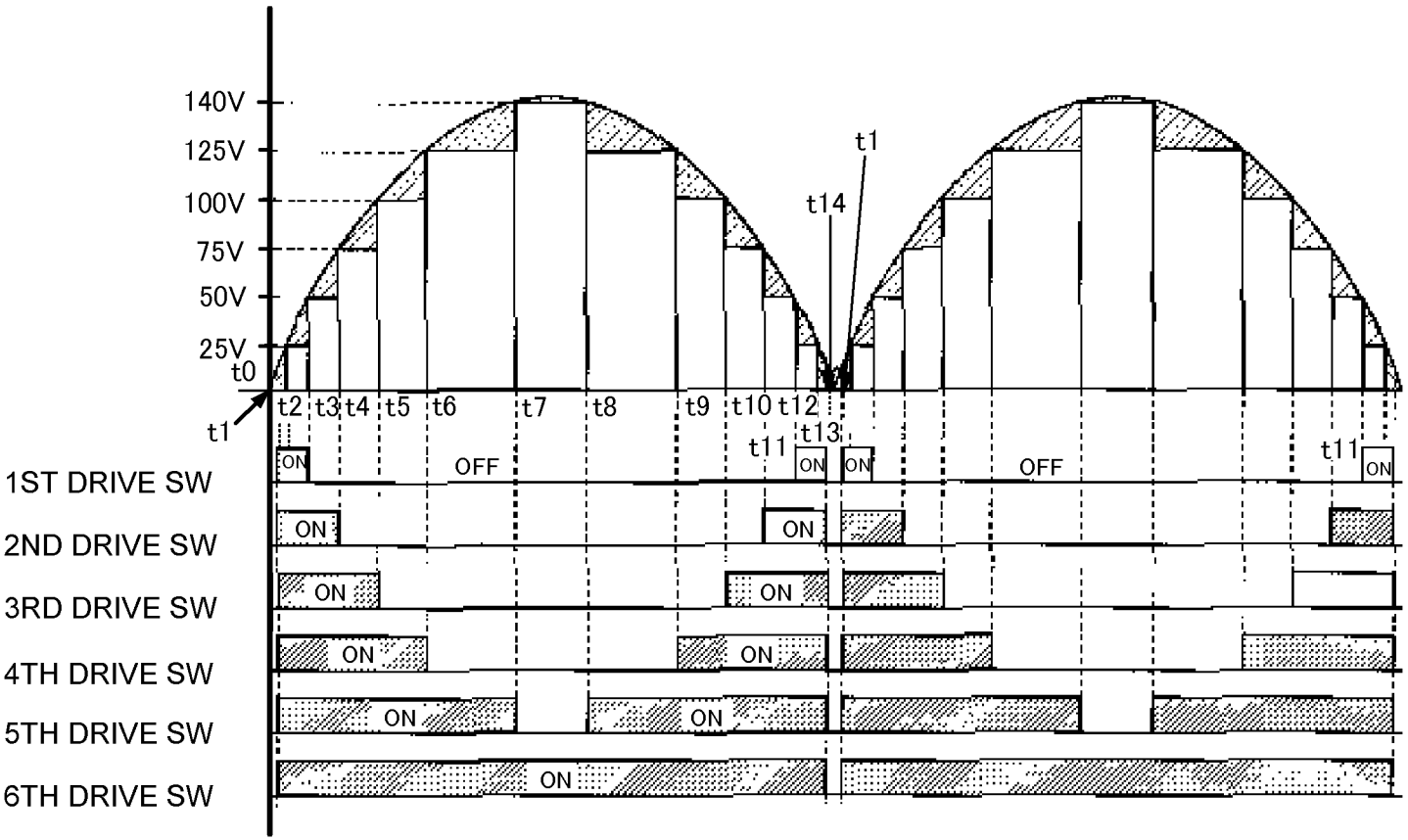
FIG. 13 PRIOR ART
FIG. 13 is a timing chart showing operation of the LED driving circuit shown in FIG. 12.

Since this light-emitting diode driving apparatus 200 can have a power supply efficiency of not less than 90%, and an improved LED operation efficiency and an improved power factor and additionally can be mainly composed of semiconductor elements, this light-emitting diode driving apparatus 200 can be small and has excellent heat resistance under LED use conditions. With reference to a current wave form shown in FIG. 3, the following description will describe operation of the current detecting/controlling portions and the current controlling portions in the exemplary circuit shown in FIG. 2 in the case where a pulsating current voltage shown in FIG. 10 is supplied. The rectifying circuit 2 rectifies an AC current of commercial power. After this rectification, a pulsating current voltage shown in FIG. 10 can be supplied as an input voltage to the LED block group 1. The operation in one cycle is now discussed. Until an applied voltage increases from 0 V to the subtotal forward directional voltage $V_{fB1}$ of the first LED block 11, a current cannot flow through the first LED block 11. Accordingly, an LED current does not flow through the LED block group in a certain period as shown in FIG. 3. In the case where eight LED devices are employed that have a forward directional voltage of 3.6 V, since the subtotal forward directional voltage $V_{fB1}$ of the eight LED devices will be 3.6×8=28.8 V, an LED current does not flow through the LED block group in a period where a pulsating current voltage falls within a range of 0 to 28.8 V.

After that, when a pulsating current voltage reaches a value in proximity to the subtotal forward directional voltage VfB1 of the first LED block 11, since all the first, second and third LED current control transistors 21A, 22A and 23A in the circuit shown in FIG. 2 are in the ON state, a current can flow through all the first, second and third bypass paths BP1, BP2 and BP3. Thus, an LED current starts flowing along a path of the first LED block 11, the first LED current control transistor 21A, the second LED current control transistor 22A, the third LED current control transistor 23A and the current detection resistor 4A in this order. A current flowing through the first LED block 11 increases as a pulsating current voltage increases. Thus, the amount of the LED current gradually increases as shown in FIG. 3. As the amount of the LED current increases, the amount of a current increases that flows from the first LED block 11 through the first, second and third bypass paths BP1, BP2 and BP3 into the LED current detection resistor 4A.

When a pulsating current voltage further increases so that a current reaches a current value that is specified by the LED current detection resistor 4A, the first current detecting transistor 31A is turned ON that has a base terminal connected to the LED current detection resistor 4A through the first base resistor 41. A collector current of the first current detecting transistor 31A gradually increases in accordance with increase of a pulsating current voltage. Accordingly, the voltage drop by the first transistor load resistor 36 increases so that a collector voltage of the first current detecting transistor drops. Thus, a gate voltage of the first LED current control transistor 21A drops, and the first LED current control transistor 21A is turned from ON to OFF. As a result, a current cannot flow through the first bypass path BP1 so that a current starts flowing through the second LED block 12. In this case, in a transition period where the first current control transistor 21A is turned from ON to OFF, in other words, until a pulsating current voltage reaches the sum of subtotal forward directional voltages $V_{fB1}+V_{fB2}$ of the first and second LED blocks 11 and 12, the second LED block 12 does not emit light, and the first LED block 11 is driven at a constant current. For this reason, the LED current flows at a level I-1 shown in FIG. 3.

When a pulsating current voltage keeps increasing in this constant current driving state and then reaches the sum of subtotal forward directional voltages $V_{fB1}+V_{fB2}$ of the first and second LED blocks 11 and 12, the second LED block 12 starts emitting light. Thus, the LED current starts increasing again as shown in FIG. 3. After that, the LED current gradually increases. Thus, the amount of a current also increases that flows through the LED current detection resistor 4A. When a current reaches a current value that is specified by the second base resistor 42 and the second base voltage dividing resistor 34, the second current detecting transistor 32A is turned ON. Accordingly, a collector current of the second current detecting transistor 32A gradually increases. As a result, the voltage drop by the second transistor load resistor 37 increases. Thus, a gate voltage of the second LED current control transistor 22A drops, and the second LED current control transistor 22A is turned from ON to OFF. Accordingly, a current cannot flow through the second bypass path BP2. As a result, a current starts flowing through the third LED block 13. Until a pulsating current voltage reaches the sum of subtotal forward directional voltages $V_{fB1}+V_{fB2}+V_{fB3}$ of the first, second and third LED blocks 11, 12 and 13, the third LED block 13 does not emit light, and the second LED block 12 is driven at a constant current. For this reason, the LED current flows at a level I-2 shown in FIG. 3.

In regard to ON/OFF switching operation and constant current driving operation, the same goes for the third LED block 13. That is, when a pulsating current voltage reaches the sum of subtotal forward directional voltages $V_{fB1}+V_{fB2}+V_{fB3}$ of the first, second and third LED blocks 11, 12 and 13, the third LED block 13 starts emitting light. Thus, the LED current starts increasing again as shown in FIG. 3. After that, the amount of a current also increases that flows through the LED current detection resistor 4A. When a current reaches a current value that is specified by the third base resistor 43 and the third base voltage dividing resistor 35, the third current detecting transistor 33A is turned ON. Accordingly, a collector current of the third current detecting transistor 33A gradually increases. As a result, the voltage drop by the third transistor load resistor 38 increases. Thus, a gate voltage of the third LED current control transistor 23A drops, and the third LED current control transistor 23A is turned from ON to OFF. Accordingly, a current cannot flow through the third bypass path BP3. As a result, a current starts flowing through the LED current restriction resistor 3A. Until a pulsating current voltage reaches the sum of subtotal forward directional voltages $V_{fB1}+V_{fB2}+V_{fB3}+V_{3B}$ of the first, second and third LED blocks 11, 12 and 13, and the LED current restriction resistor 3A, a current does not flow through the LED current restriction resistor 3A, and the third LED block 13 is driven at a constant current. For this reason, the LED current flows at a level I-3 shown in FIG. 3.

When a pulsating current voltage reaches a value in proximity to its maximum voltage, all the LED current control transistors 21A, 22A and 23A are completely turned OFF so that a current flows through all the LEDs via the LED current restriction resistor 3A and the LED current detection resistor 4A. Therefore, it is possible to effectively use electric power when a pulsating current voltage reaches a value in proximity to its maximum voltage. However, the current controlling portion for the final block is not necessarily turned OFF. For example, even in the case where LED current control transistor 23A is kept ON, a current can flow through all the LEDs. In this case, since the LED current control transistor 23A is not turned OFF, a current can be restricted by constant current control when an input voltage is close to its peak range.

After a pulsating current voltage reaches its maximum voltage 141 V, the voltage value of a pulsating current voltage decreases. Thus, the light-emitting diode driving apparatus drives the LEDs in the order opposite to the aforementioned operation pattern. After a pulsating current voltage reaches its minimum voltage 0 V, the voltage value of a pulsating current voltage increases again. Thus, the light-emitting diode driving apparatus drives the LEDs in the same order as the aforementioned operation pattern again.

As discussed above, constant current driving operation can be specified at any level by specifying the resistance of the LED current detection resistor 4A and the base voltage dividing resistances of the current detecting transistors. According to the aforementioned exemplary circuit, since coils and large-capacitance capacitors are not employed, it is possible to provide a small, inexpensive, lightweight and high-performance LED driving apparatus. In addition, since high-frequency operation is not conducted, it can be expected that harmonics noise will be suppressed.

According to the aforementioned method, light emission is controlled based on the amount of a current that actually flows through the LED blocks and the like, it is possible to provide accurate light emission control independent of property deviation of LED devices, in particular, of Vf deviation of LED devices. In addition, the control can be provided by a very simple circuit structure, and does not require an expensive controlling device such as microcomputer. Such a very simple circuit structure can be composed of only semiconductor elements. Therefore, the cost of LED driving apparatus can be reduced.

In the case where circuit parameters are designed to provide an LED current wave form shown in FIG. 3, actual measurement values are power supply efficiency=90%, LED operation efficiency=50%, and power factor=98%. It can be confirmed that the LED operation efficiency and the power factor of LED driving apparatus are improved as compared with a constant current circuit.

In the aforementioned configuration, three LED blocks have different operation efficiencies. The power ratio of LED blocks is (first LED block):(second LED block):(third LED block)=100:95:74, where the first LED block having the highest operation efficiency is defined as 100. Note that, although LED blocks have illumination difference, the extent of illumination difference is not clearly visually perceivable. The effect of the illumination difference can be prevented by adjusting arrangement of the LED devices. The illumination difference may not cause a practical problem.

Figure 14:
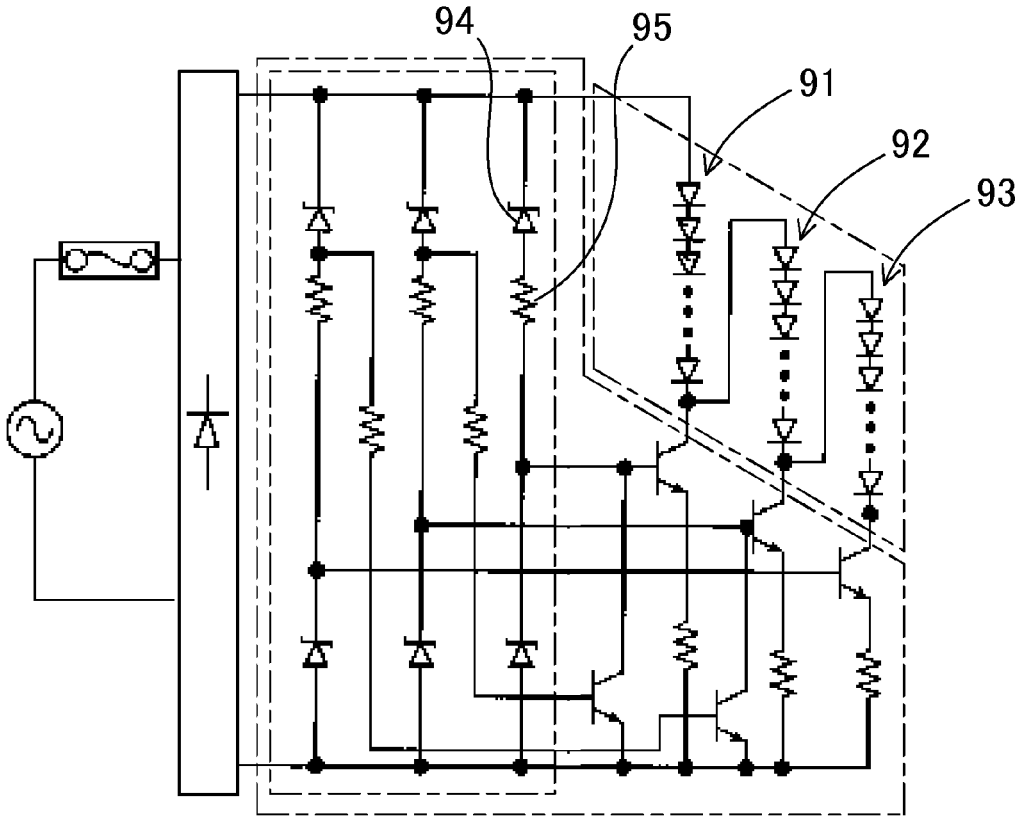
FIG. 14 PRIOR ART
FIG. 14 is a circuit diagram showing an exemplary LED driving circuit that does not employ a microcomputer.
Figure 15:
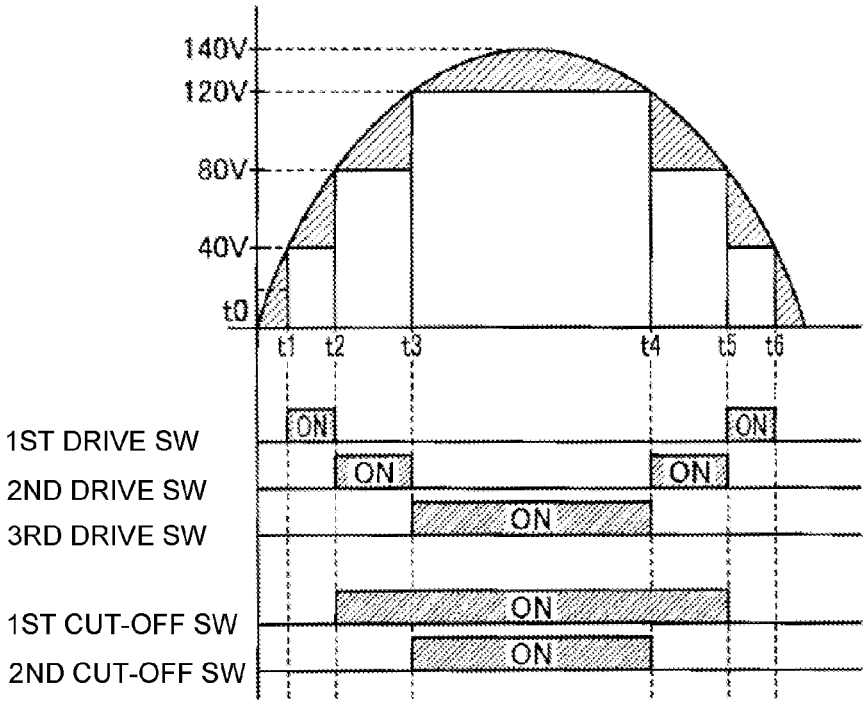
FIG. 15 PRIOR ART
FIG. 15 is a timing chart showing operation of the LED driving circuit shown in FIG. 14.

According to the aforementioned configuration, it is possible to provide an LED driving apparatus capable of smoothing out Vf deviation and Vf temperature characteristic deviation of light-emitting diode devices as compared with a conventional circuit shown in FIG. 14. In the circuit shown in FIG. 14, light emission of LED blocks is switched based on an input voltage. For this reason, it is necessary to accurately match a switching voltage value for switching light emission of LED blocks with the Vf value of LED devices that compose each LED block. However, since difference exists among LED devices, LED devices have Vf deviation and temperature characteristic deviation. For this reason, actually, it is very difficult to accurately adjust the switching voltage to the Vf value of LED devices.

In contrast to the circuit shown in FIG. 14, according to this example, the LED blocks are switched based not on a voltage but on a current. That is, the LED blocks are driven at a constant current, and additionally current values for switching light emission of the LED blocks are adjusted block by block so that the LED blocks are switched ON block by block. In other words, the LED blocks are driven at the same constant current value in the circuit shown in FIG. 14, but the LED blocks are driven at different constant current values in this example. According to this method, the Vds voltage of FET as the LED current control transistor can be wide. Accordingly, while an LED block is driven at a constant current by the FET, a current starts flowing through other LED block which the current has bypassed. According to this example, it is possible to easily provide operation capable of thus smoothing out Vf deviation and temperature characteristic deviation. Therefore, it is possible to provide a very practical and useful circuit structure.

In addition to this, a flowing current amount in the LED blocks is fixed in the circuit shown in FIG. 14, but a current is adjusted to different current values in the aforementioned configuration. Accordingly, an LED block emitting light longer than other LED blocks is applied with a suppressed amount of current. Therefore, the life of LED block emitting light longer can be improved. Specifically, the first LED block emits light for the longest time, and the third LED block emits light for the shortest time. For this reason, the constant current control amount, i.e., a flowing current amount in the first LED block is adjusted to the smallest value, and a flowing current amount in the third LED block is adjusted to the greatest value. Since a current value can be small when the first LED block emits light and the third LED block does not emit light, it is possible to suppress the heat amount (current value×light emission time). That is, it is possible to suppress deterioration of the first LED block as compared with the third LED block. The same goes for relationship with the second LED block. Since the amount of a current in constant current control is not fixed but changed so that the LED block emitting light longer time is driven at a smaller current value, unevenness of the life characteristics of light-emitting diode devices can be reduced. Therefore, it is possible to control light emission so that light-emitting diodes can be more stably used for longer term.

In addition, if a current value is fixed as in the circuit shown in FIG. 14, the power factor will decrease. In contrast to the circuit shown in FIG. 14, in the case where a current wave form has a shape close to the input voltage waveform as shown in FIG. 3, etc., the power factor can be improved.

Example 2

Figure 4:
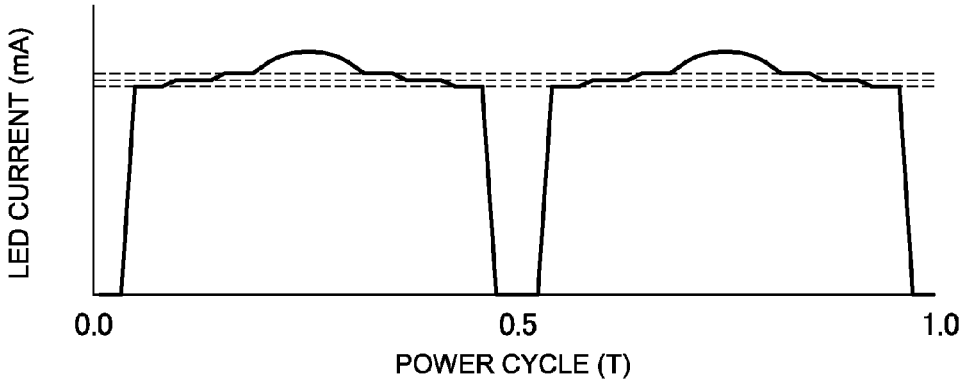
FIG. 4 is a graph showing a current wave form in a light-emitting diode driving apparatus according to an example 2.

In the foregoing example, operation is controlled in consideration of power factor. In particular, since the LED blocks of LED block group 1 are connected to each other in series by one line in the exemplary circuit shown in FIG. 2, in the case where the LED blocks are driven at different current values, a current wave form has a stepped shape as shown in the graph of FIG. 3. In contrast to this, FIG. 4 shows an exemplary current waveform according to example 2 in that greater importance is placed on operation efficiency rather than power factor. According to exemplary control of this example, constant current values for LED blocks are specified closer to each other than the exemplary control of the example shown in FIG. 3 by specifying the resistances of the resistors and the like. Accordingly, the entire current amount is increased to increase the output of the LED driving apparatus. Therefore, it is possible to provide bright lighting. In the case where circuit parameters are designed to provide an LED current wave form shown in FIG. 4, actual measurement values are power supply efficiency=90%, LED operation efficiency=53%, and power factor=95%. As compared with the example 1, it can be confirmed that, although the power factor in this example is slightly smaller, the LED operation efficiency can be improved. As discussed above, even in the case of the same circuit configuration, a lighting apparatus meeting desired specifications can be provided by selecting circuit parameters.

Example 3

In the foregoing examples, the LED current detecting resistor is a common resistor to the LED blocks, and the like. That is, since the current detecting/controlling portions control LED light emission based on the amount of a current of the common current detecting portion, the circuit configuration can be simple. However, LED current detecting resistors can be provided block by block, and the like. This type of circuit is shown as an example 3 in a circuit diagram of FIG. 5. A light-emitting diode driving apparatus 300 shown in this Figure has a basic configuration similar to the example 1, and operate similarly to the example 1. However, the light-emitting diode driving apparatus 300 includes LED current detecting resistors that are provided for the three LED blocks. Specifically, first, second and third LED current detection resistors 4B, 4C and 4D detect currents in the first LED block 11, the first and second LED block 11 and 12 and the first, second and third LED block 11, 12 and 13, respectively. In this example, the LED current control transistors, which compose the current controlling portion, employ not FETs but bipolar transistors. More specifically, the LED current control transistor is composed of two bipolar transistors that are connected to each other to form a Darlington transistor.

Figure 5:
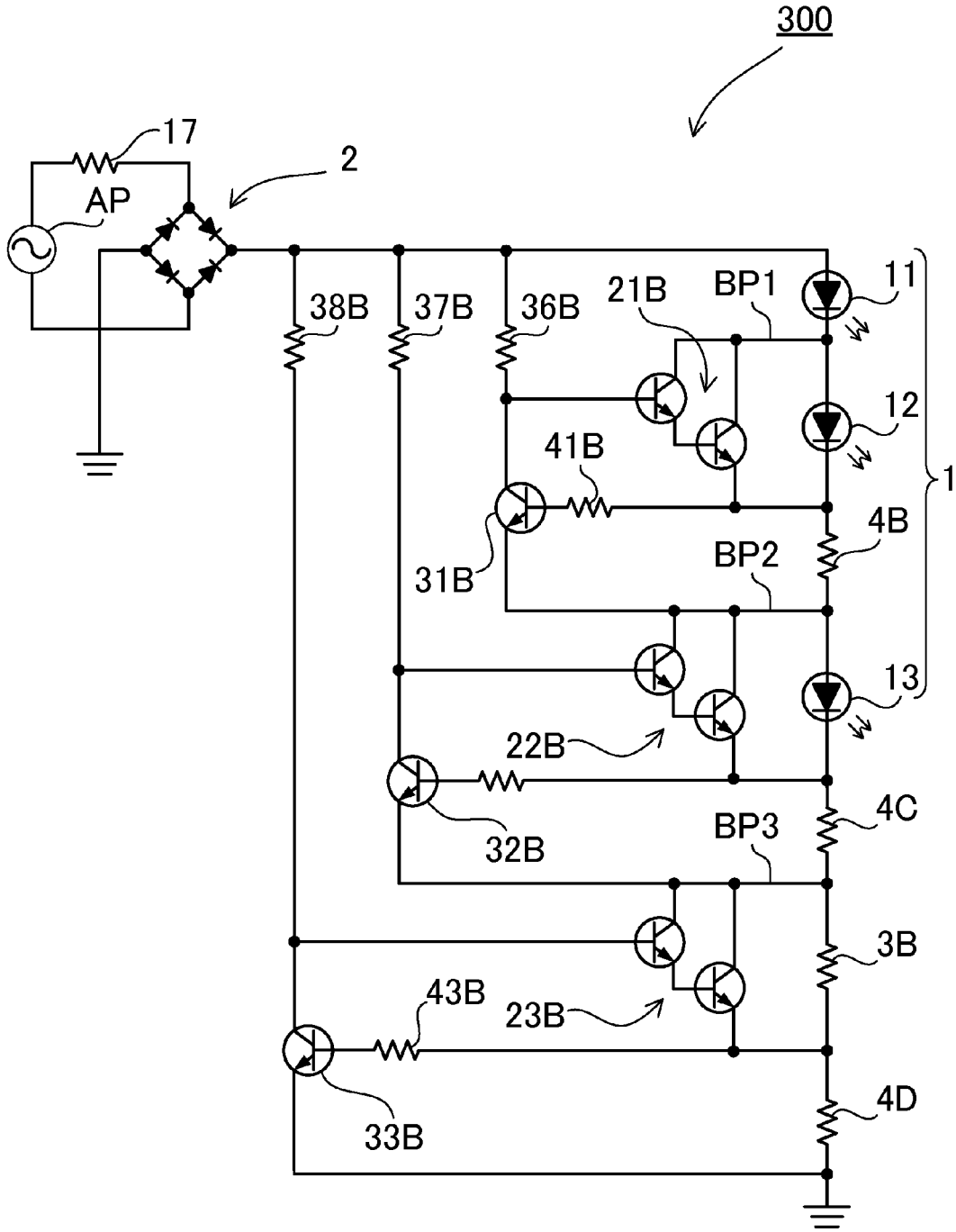
FIG. 5 is a circuit diagram showing a light-emitting diode driving apparatus according to an example 3.

According to control by the circuit shown in FIG. 5, the LED current can have a current wave form as shown in FIG. 3 or 4. The following description will describe exemplary control by the circuit shown in FIG. 5 that provides a current wave form as shown in FIG. 3. Similarly to the example 1, an AC voltage of commercial power is rectified by the protection resistor 17 and the rectifying circuit 2 so that a pulsating current voltage shown in FIG. 10 is provided. A bypass capacitor is not employed in the exemplary circuit shown in FIG. 5. Until an applied voltage increases from 0 V to the subtotal forward directional voltage $V_{fB1}$ of the first LED block 11, a current is blocked by the first LED block 11 and cannot flow through the first LED block 11. When a pulsating current voltage reaches a value in proximity to the subtotal forward directional voltage $V_{fB1}$ of the first LED block 11, all of first, second and third LED current control transistor 21B, 22B and 23B shown in the circuit diagram of FIG. 5 will be turned ON. Thus, a current can flow through all of the first, second and third bypass paths BP1, BP2 and BP3. Accordingly, a current flows along a path of the first LED block 11, the first LED current control transistor 21B, the first LED current detection resistor 4B, the second LED current control transistor 22B, the second LED current detection resistor 4C, the third LED current control transistor 23B, and the third LED current detection resistor 4D in this order. A current flowing through the first LED block 11 increases as a pulsating current voltage increases. Thus, the amount of a current gradually increases that flows through the first LED current detection resistor 4B.

When a pulsating current voltage further increases so that a current reaches a current value that is specified by the first LED current detection resistor 4B, the first current detecting transistor 31B is turned ON that has a base terminal connected to the first LED current detection resistor 4B through the first base resistor 41B. The collector current of the first current detecting transistor 31B gradually increases in accordance with increase of a pulsating current voltage. As a result, a base current decreases that flows from the first transistor load resistor 36B to the first LED current control transistor 21B so that the first LED current control transistor 21B is switched from ON to OFF. As a result, a current cannot flow through the first bypass path BP1 so that a current starts flowing through the second LED block 12. In this case, until a pulsating current voltage reaches the total subtotal forward directional voltages $V_{fB1}+V_{fB2}$ of the first and second LED blocks 11 and 12, the second LED block 12 does not emit light, and the first LED block 11 is driven at a constant current.

When a pulsating current voltage increases in this constant current driving state and reaches the sum of subtotal forward directional voltages $V_{fB1}+V_{fB2}$ of the first and second LED blocks 11 and 12, the second LED block 12 starts emitting light. After that, the amount of a current also increases that flows through the second LED current detection resistor 4C. When a current reaches a current value that is specified by a second base resistor 42B, the second current detecting transistor 32B is turned ON. Then, a collector current of the second current detecting transistor 32B gradually increases. Accordingly, a current decreases that is branched through a second transistor load resistor 37B and flows into the second LED current control transistor 22B. Thus, a base current of the second LED current control transistor 22B decreases so that the second LED current control transistor 22B is switched from ON to OFF. As a result, a current cannot flows through the second bypass path BP2 so that a current starts flowing through the third LED block 13. Until a pulsating current voltage reaches the sum of subtotal forward directional voltages $V_{fB1}+V_{fB2}+V_{fB3}$ of the first, second and third LED blocks 11, 12 and 13, the third LED block 13 does not emit light, and the second LED block 12 is driven at a constant current.

Similarly, when a pulsating current voltage reaches the sum of subtotal forward directional voltages $V_{fB1}+V_{fB2}+V_{fB3}$ of the first, second and third LED blocks 11, 12 and 13, the third LED block 13 starts emitting light. Thus, the LED current starts increasing again. After that, the amount of a current also increases that flows through the third LED current detection resistor 4D. When a current reaches a current value that is specified by a third base resistor 43B, the third current detecting transistor 33B is turned ON. Then, a collector current of the third current detecting transistor 33B gradually increases. Accordingly, a current that is branched through a third transistor load resistor 38B and flows into the third LED current control transistor 23B side is additionally branched to the third current detecting transistor 33B. Thus, a base current of the third LED current control transistor 23B decreases so that the third LED current control transistor 23B is switched from ON to OFF. As a result, a current cannot flows through the third bypass path BP3 so that a current starts flowing through the LED current restriction resistor 3B.

When a pulsating current voltage reaches a value in proximity to its maximum voltage, all the LED current control transistors 21B, 22B and 23B are completely turned OFF so that a current flows through all the LEDs via the LED current restriction resistor 3B, the first, second and third LED current detection resistor 4B, 4C and 4D. Therefore, it is possible to effectively use electric power when a pulsating current voltage reaches a value in proximity to its maximum voltage. After a pulsating current voltage reaches its maximum voltage 141 V, the voltage value of a pulsating current voltage decreases. Thus, the light-emitting diode driving apparatus drives the LEDs in the order opposite to the aforementioned operation.

According to this exemplary circuit, current values that activate the LED blocks and the current restricting portion 3 can be easily and individually adjusted by the LED current detection resistors. However, since a plurality of LED current detection resistors are employed, there are disadvantages in that they may increase heat loss, and in that the LED blocks may serves as divided modules. On the other hand, there is an advantage in that wiring has no crossover, and three-dimensional wiring is not required so that the circuit configuration can be simple dissimilar to the circuit shown in FIG. 2, etc. In this circuit, the first current controlling portion 21, the first current detecting/controlling portion 31, and the first current detecting portion 4B compose the first switching portion that switches ON/OFF of the first bypass path BP1 based on a flowing current amount in the first LED block 11. Also, the second current controlling portion 22, the second current detecting/controlling portion 32, and the second current detecting portion 4C compose the second switching portion that switches ON/OFF of the second bypass path BP2 based on a flowing current amount in the first LED block 11 and the second LED block 12.

In all the foregoing embodiments 1 to 3, the first, second and third LED blocks are turned ON in this order, and then the third, second and first LED blocks are turned OFF in this order. Accordingly, the light emission periods of the LED blocks are different from each other. For this reason, in order that it may not be perceivable that the third LED block is turned OFF for longer time, it is preferable that the LED devices of each LED block are not arranged gathered but distributed. For example, in a later-discussed lighting apparatus shown in FIG. 6, rows of LED devices belonging to the first, second and third LED blocks are alternately arranged so that a row of LED devices of the first LED block, a row of LED devices of the second LED block, a row of LED devices of the third LED block, a row of LED devices of the first LED block, . . . , and a row of LED devices of the third LED block are arranged. Alternatively, LED devices belonging to the first, second and third LED blocks are alternated not line by line but dot by dot. Specifically, LED devices belonging to the first, second and third LED blocks are alternately arranged from the left top end toward right sides in the top row so that an LED device of the first LED block, an LED device of the second LED block, an LED device of the third LED block, an LED device of the first LED block, . . . , and an LED device of the third LED block are arranged. In the second row, this alternated arrangement is shifted by one dot so that an LED device of the third LED block, an LED device of the first LED block, an LED device of the second LED block, an LED device of the third LED block, . . . , and an LED device of the first LED block are arranged. This shift is repeated row by row. Also, LED devices belonging to the first, second and third LED blocks can be alternated not only one by one but two by two or three or more by three or more. Also, the arrangement of LED devices belonging to the first, second and third LED blocks is not limited to such periodic arrangement but can be random arrangement, or the like. In the case where LED devices belonging to the first, second and third LED blocks are thus suitably distributed, the difference among light emission periods of the LED blocks cannot be perceivable. As a result, when the LED driving apparatus periodically drives the LED devices at 60 Hz of commercial power, user will not perceive the flicker. Therefore, the LED driving apparatus can be used similarly to LED devices that continuously emit light. Also, in the case where an inverter circuit or the like is additionally employed to bring the light emission cycle shorter, the same effect can be provided.

In the aforementioned configuration, the LED blocks have different operation periods. Specifically, the light emission period of the first LED block is the longest, and the light emission period of the third LED block is the shortest. From this viewpoint, the different operation periods can also be taken into consideration to suppress life deviation of LED devices. Since LED blocks are connected to each other in series in the aforementioned circuit configuration, it is difficult to control of voltages of the LED blocks one by one. To address this, the number of LED devices connected to each other can be increased in an LED block with longer operation period. Also, LED devices can be connected to each other not only in series but also in parallel so that a current amount per LED device can be reduced. Therefore, it is possible to reduce heat loss.

Although it has been described that the number of LED blocks is three in the aforementioned configuration, the number of LED blocks can also be two, or four or more as discussed above. For example, the light-emitting diode driving apparatus shown in FIG. 1 can further include a fourth LED block, a fourth current controlling portion, and a fourth current detecting/controlling portion. The fourth LED block is composed of a plurality of light-emitting diodes, and is connected between the third LED block and the current restricting portion. The fourth current controlling portion is connected to the current restricting portion in parallel, and restricts a flowing current amount in the first, second, third and fourth LED blocks. The fourth current detecting/controlling portion controls the restriction amount on a flowing current in the first, second, third and fourth LED blocks by the fourth current controlling portion. In this case, the third current controlling portion is connected in parallel not to the current restricting portion but to the fourth LED block. Since the number of LED blocks is increased, the LED block switching transition can be smoother. Therefore, it is possible to further improve the LED operation efficiency. Also, the number of LED blocks can be increased to five or more so that the LED block switching transition is still smoother.

Example 4

Figure 6:
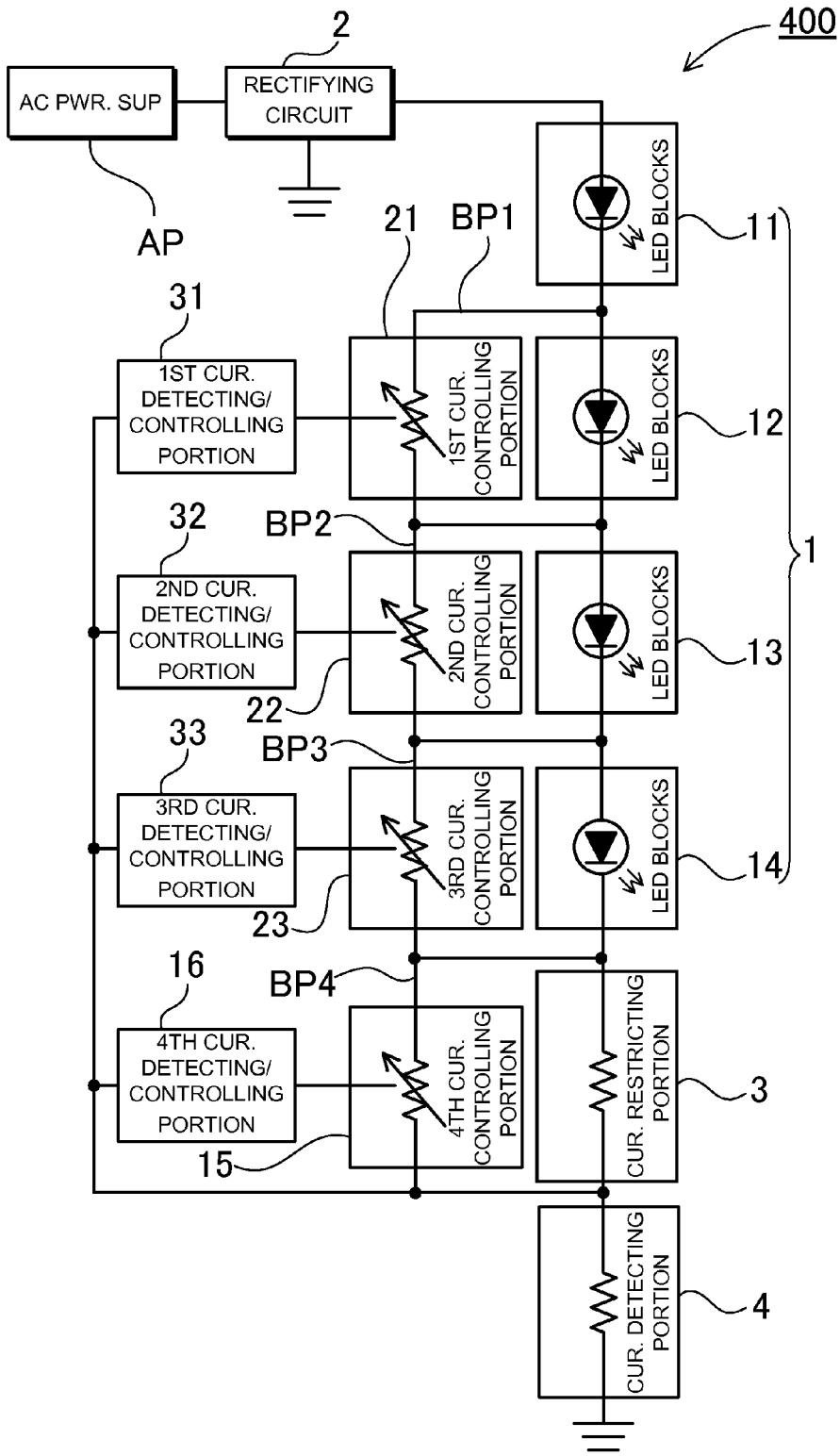
FIG. 6 is a block diagram showing a light-emitting diode driving apparatus according to an example 4.

A light-emitting diode driving apparatus 400 according to an example 4 includes four LED blocks. FIG. 6 shows a circuit diagram of the light-emitting diode driving apparatus 400. This illustrated light-emitting diode driving apparatus includes a fourth LED block 14 connected between the third LED block 13 and the current restricting portion 3, dissimilar to the light-emitting diode driving apparatus shown in FIG. 1, etc. In this example, although the third current controlling portion 23 is connected to the current restricting portion 3 in parallel in the foregoing example, the third current controlling portion 23 is connected to the fourth LED block 14 in parallel. A fourth current controlling portion 15 is connected to the current restricting portion 3 in parallel. In addition, the fourth current controlling portion 15 is connected to the fourth current detecting/controlling portion 16. The fourth current controlling portion 15 restricts a flowing amount in the first, second, third and fourth LED blocks 11, 12, 13 and 14. The fourth current detecting/controlling portion 16 also controls the restriction amount on a flowing current in the first, second, third and fourth LED blocks 11, 12, 13 and 14 by the fourth current controlling portion 15. Since the number of LED blocks is increased so that the number of constant currents is increased that is applied to the LED blocks in constant current control, the LED block switching transition can be smoother.

Example 5

Figure 7:
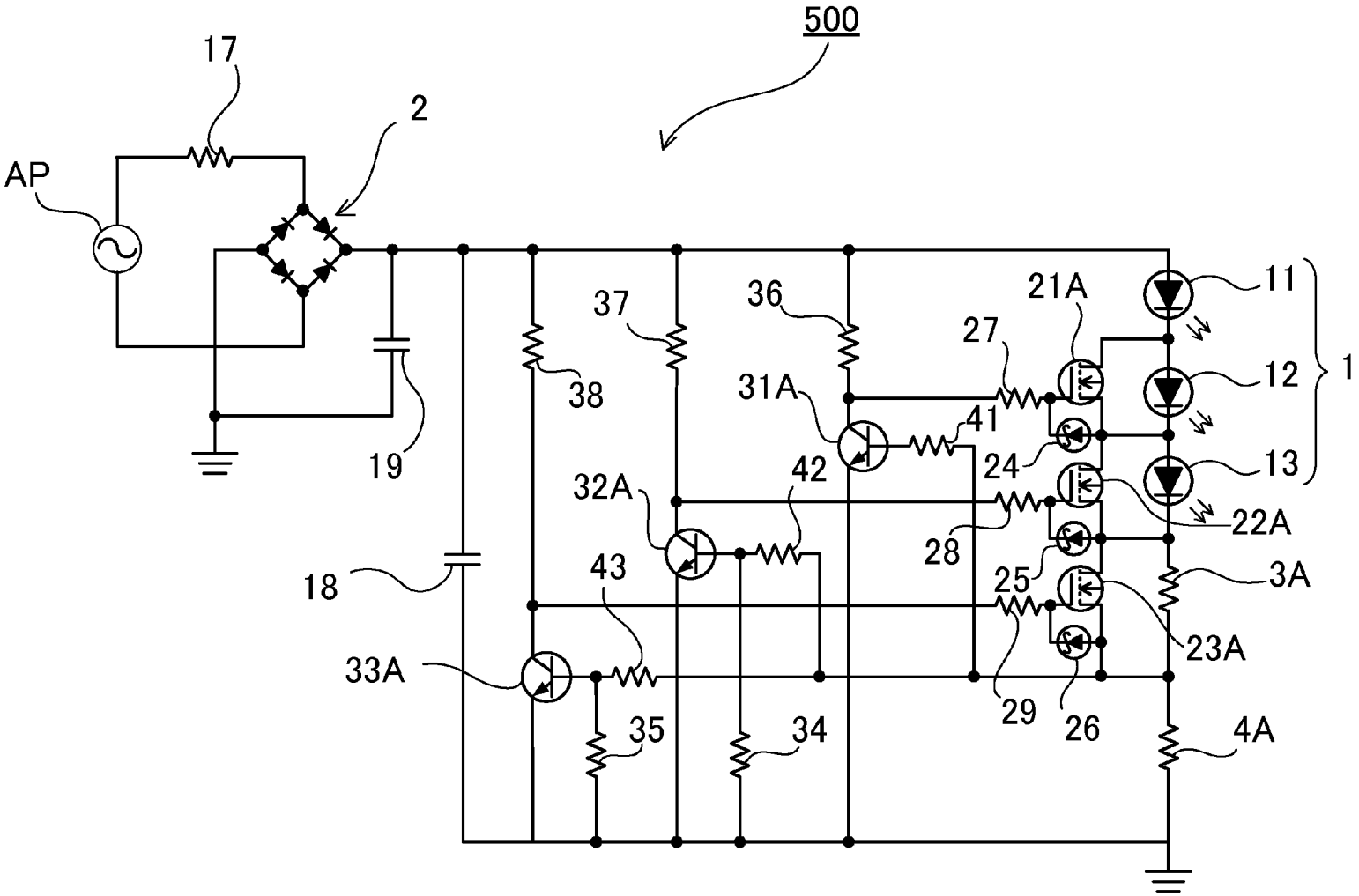
FIG. 7 is a circuit diagram showing a light-emitting diode driving apparatus according to an example 5.
Figure 8:
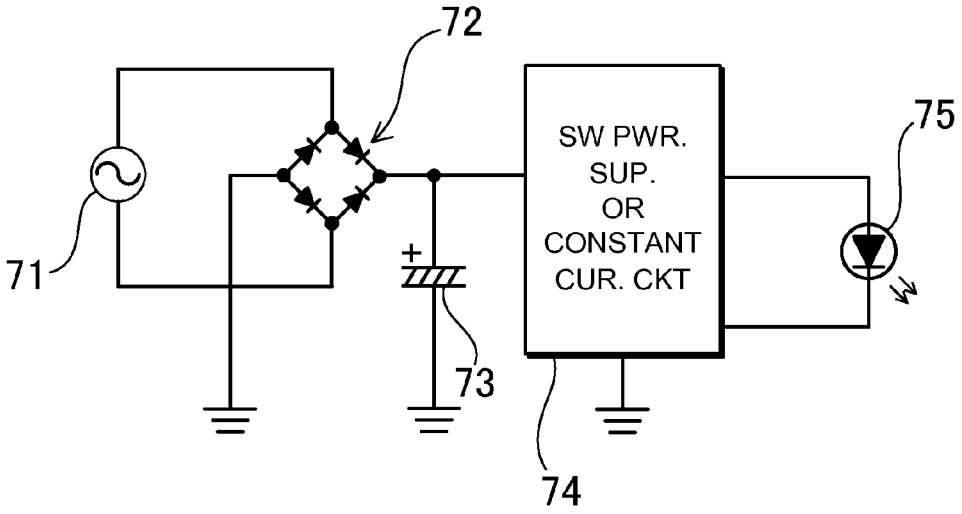
FIG. 8 PRIOR ART
FIG. 8 is a circuit diagram showing a conventional LED driving circuit.
Figure 9:
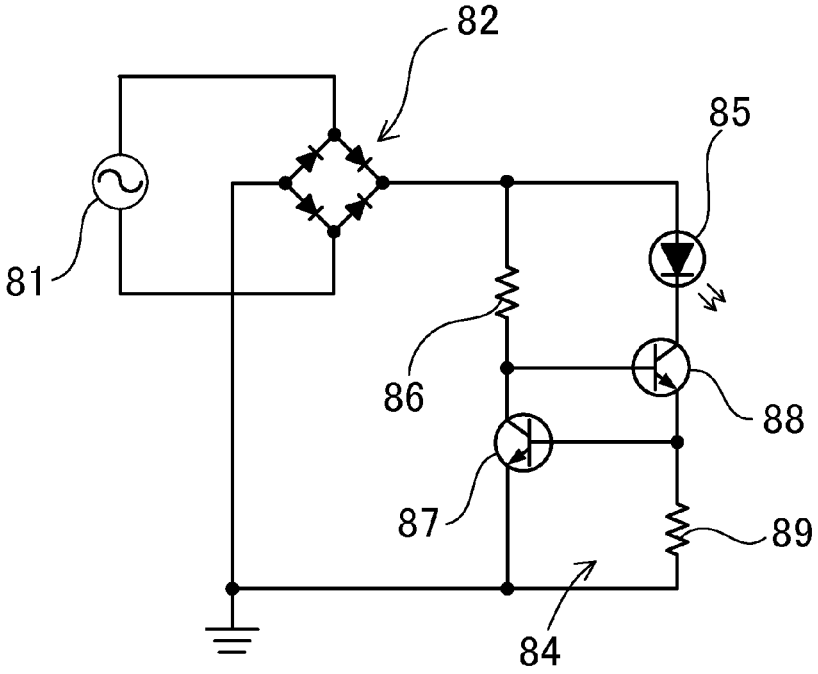
FIG. 9 PRIOR ART
FIG. 9 is a circuit diagram showing another conventional LED driving circuit.

FIG. 7 shows a light-emitting diode driving apparatus 500 according to an example 5 that improves its crest factor by employing a multistage circuit. The light-emitting diode driving apparatus 500 shown in FIG. 7 has the substantially same configuration as the exemplary circuit shown in FIG. 2 except for the capacitor 18. Components same as those of the exemplary circuit shown in FIG. 2 are attached with the same reference numerals and their description is omitted.

The light-emitting diode driving apparatus 500 shown in FIG. 7 can prevent that all the light-emitting diodes are turned OFF in a low pulsating current voltage range, in other words, can prevent so-called stroboscopic effect. When a pulsating current voltage obtained from AC power supply is close to 0 V, a forward directional voltage applied to the LED devices becomes too low to drive any of the LED devices. For this reason, a no-emission range of pulsating current voltage periodically appears in that all the LED devices are turned OFF. Stroboscopic effect refers to a phenomenon in that, when an object is illuminated that moves in synchronization with the no-emission period, the object appears to be slow-moving, or stationary. For example, in the case where an AC-driven LED lighting apparatus illuminate a stamping apparatus that is used in a factory and includes a metal mold moving in the vertical direction, if the period of the metal mold moving in the vertical direction is unexpectedly synchronized with the no-emission period of the LED lighting apparatus, the metal mold may appear to be stationary. In addition, there are problems in that lighting flicker may get user's eyes tired, and in that movement of an object may appear to be unnatural.

An example of a numerical evaluation index of stroboscope effect can be provided by a crest factor (crest value). A crest factor is defined by (peak of light flux)/(effective value of light flux). It can be said that a crest factor closer to 1.0 is a stable, good value. In the case where LED devices are driven by a direct current, the crest factor will be 1.0. However, in the case where LED devices are periodically driven as in the case of this application, the crest factor will be more than 1.0. JIS Standard requires fluorescent lamps to have a crest factor of not more than 1.2. In other words, as the crest factor of a light source is getting closer to 1.0, the stroboscope effect is less likely to occur. For this reason, it can be said that a light source having a crest factor closer to 1.0 can be used for general purposes. Although as of now there are no particular standards for LED lighting apparatus, it is conceivable that LED lighting apparatuses having a crest factor of not more than 1.3 can be practically used. If the aforementioned current wave form shown in FIG. 3 is provided by a multistage circuit, the crest factor of the LED lighting apparatus will be set to 1.4 to 1.6. Also, in the case where the current wave form as shown in FIG. 4 is refined to the limit, it is found that the crest factor can be reduced to about 1.34.

As discussed above, the aforementioned multistage circuit can achieve a crest factor of about 1.3. For this reason, the LED lighting apparatus can be sufficiently actually used in applications in that crest factor is important.

In order to achieve a crest factor closer to 1.0, LEDs are required to emit light even in a range in that a current is a value in proximity to zero in FIG. 4. However, in this range, since an input voltage is very low, a sufficient voltage cannot be applied to the LED devices. For this reason, it is necessary to change the circuit into configuration capable of applying a sufficient voltage to the LED devices. To achieve this, it is necessary to provide additional elements, which in turn causes problems such as circuit complication, power consumption increase, circuit size increase, manufacturing cost increase, and the like.

In contrast to this, the light-emitting diode driving apparatus 500 according to the example 5 includes a capacitor 18 that is connected between the output side of the rectifying circuit 2 and the ground as shown in FIG. 7. The capacitor 18 is thus connected to the output side of the rectifying circuit 2 in parallel. Accordingly, when a voltage decreases, a current is applied to the LED devices from the capacitor 18. As a result, even in that range, a current flows through the LED devices of the first LED block 11 so that the LED devices of the first LED block 11 can emit light. Consequently, since the LED devices of the first LED block 11 can constantly emit light, it is possible to prevent the stroboscope effect. According to an experiment by the inventors, when an electrolytic capacitor with a capacitance of 10 μF is provided, it is found that the crest factor is reduced to about 1.2. Also, the crest factor can be reduced to about 1.2 by a capacitor with a smaller capacitance.

In the case of capacitors used in the typical constant current circuit or a circuit including resistors, such capacitors are required to have a capacitance of about 100 to 300 μF. As of now, a capacitor with such a large capacitance can be realized only by an electrolytic capacitor. In addition, such an electrolytic capacitor will be large-sized. If such a large-sized capacitor is mounted on a circuit board together with the LED devices, the capacitor may interfere with light distributed from the LED devices, and may affect compact design. In addition, the life of electrolytic capacitors is limited, and very short as compared with the life of LED devices. For this reason, the life of the LED driving apparatus is limited to the life of the electrolytic capacitor. In this case, the LED driving apparatus loses the advantage of LED devices essentially having long life.

In contrast to this, since a capacitance of about 10 μF is enough for a capacitor that is employed in the multistage circuit according to the example 5, the multistage circuit according to the example 5 can be composed of a very long life component such as film capacitor. Thus, the required capacitance can be small in the multistage circuit. The reason is that the LED driving apparatus is configured based on the idea in that, when an input voltage is low, only a part of LED device group consisting of serially-connected LED devices emits light. In other words, the reason is that, even if a voltage be stored by the capacitor is low, a certain low voltage is enough to drive LED devices.

As discussed above, since the light-emitting diode driving apparatus 500 according to the example 5 can achieve a good crest factor, the light-emitting diode driving apparatus 500 can serve as an LED lighting apparatus driven by AC power supply. In addition, the crest factor of the LED driving apparatus can be optimized while the life of the LED driving apparatus is not limited to the capacitor.

Example 6

Figure 19:
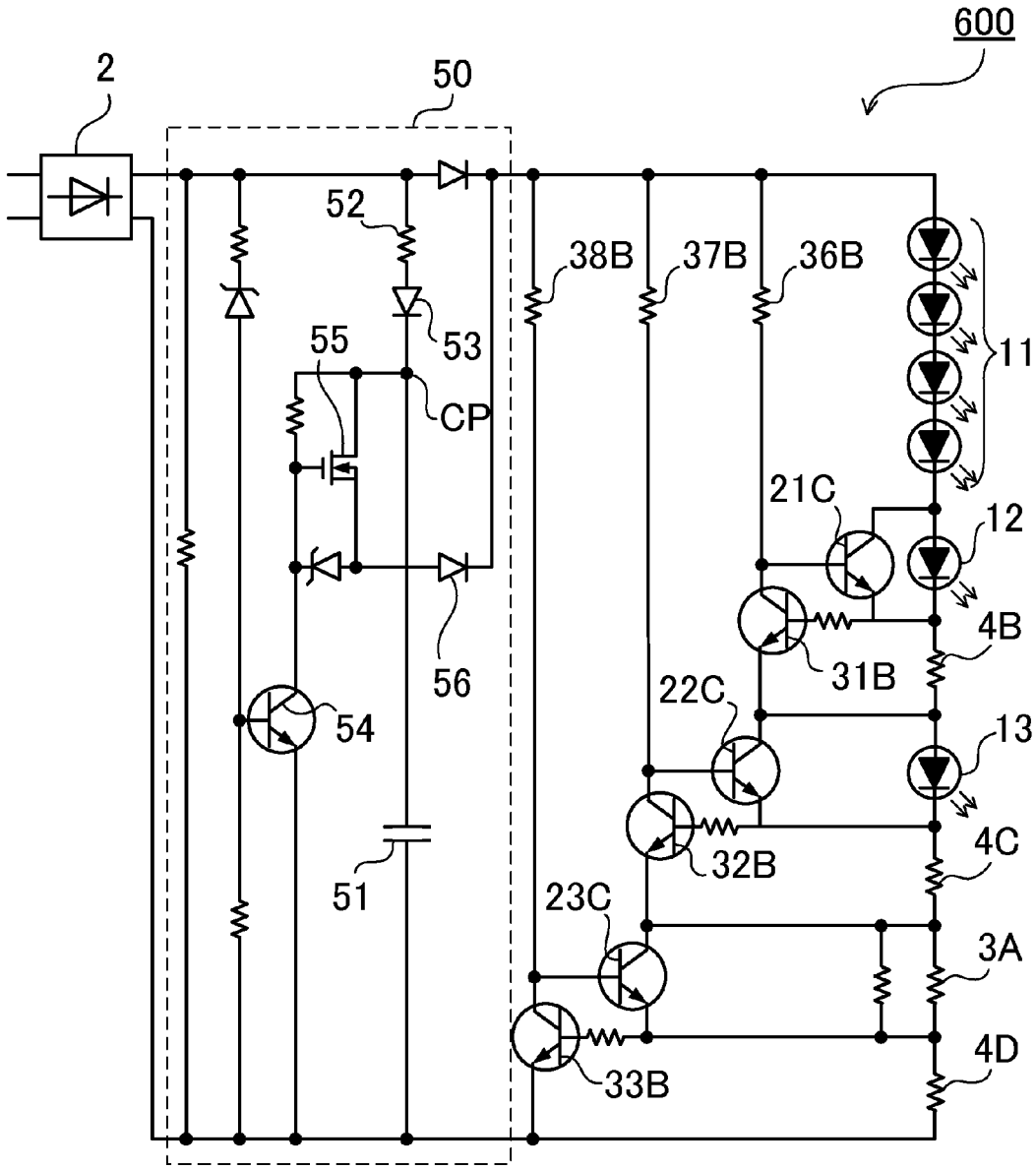
FIG. 19 is a circuit diagram showing a light-emitting diode driving apparatus according to an example 6.

FIG. 19 shows a light-emitting diode driving apparatus 600 according to an example 6. This illustrated light-emitting diode driving apparatus 600 includes a smoothing circuit 50 that does not start discharging a current until an input voltage decreases to a predetermined capacitor discharging start voltage. In order to prevent that all the light-emitting diodes are turned OFF in a range in that a pulsating current voltage is low, that is, in order to prevent so-called stroboscope effect, typically, the output side of the rectifying circuit 2 is connected to a smoothing capacitor that smoothes an input voltage after full-wave rectification. However, the smoothing capacitor is required to have a large capacitance. For example, in the case where a 10-W output light source is provided, a 9.4-μF capacitor is employed. If an electrolytic capacitor is used as a large-capacitance capacitor, its durability causes a problem. On the other hand, in the case where a plurality of film capacitors as a smoothing capacitor portion 73 are connected to each other in parallel to provide an enough capacitance, there is a problem in that the plurality of film capacitors increase cost and space. To address the problems, a circuit according to the example 6 shown in FIG. 19 is configured to start discharging electric charge stored in the smoothing capacitor in the range in that an input voltage is low.

Figure 16:
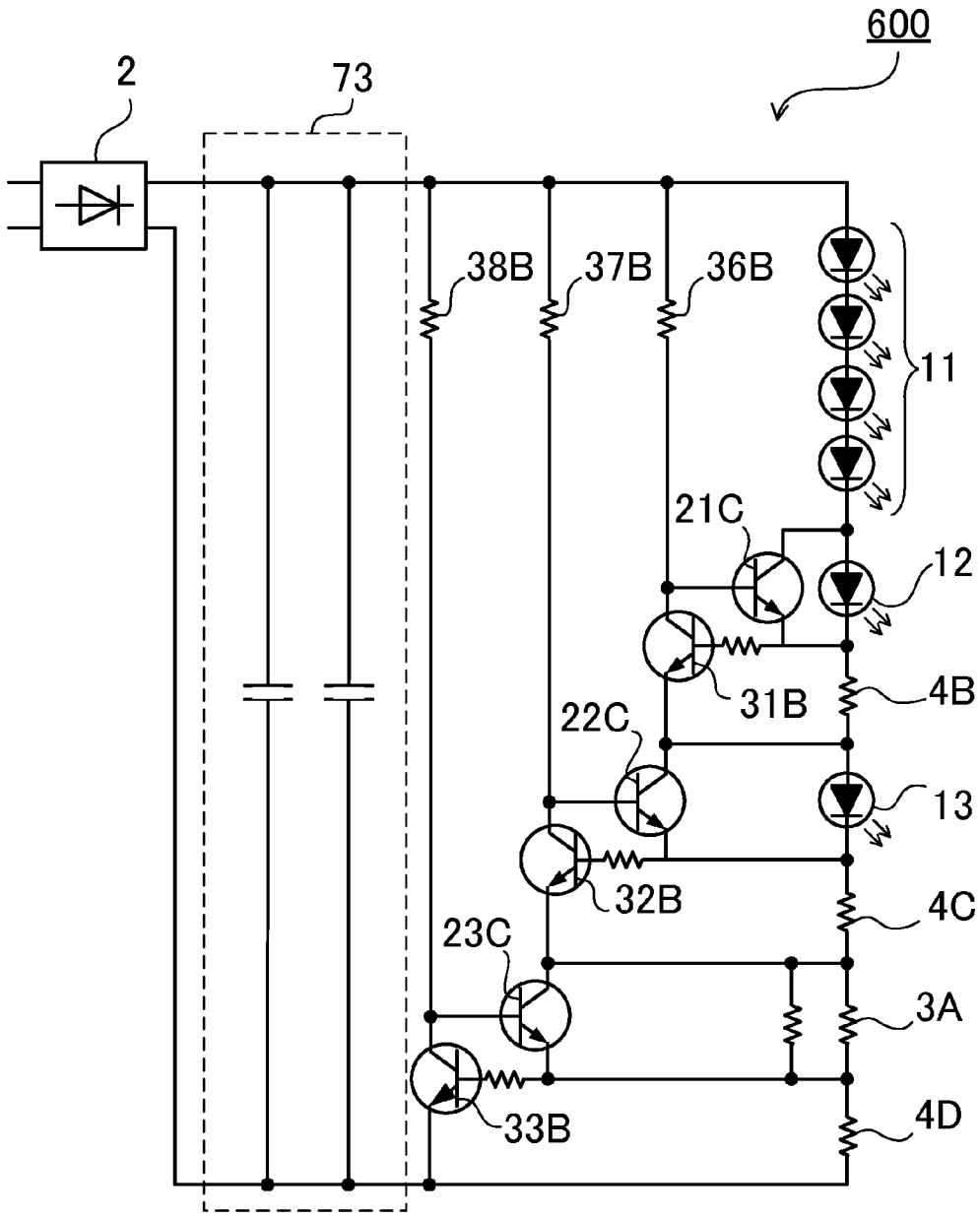
FIG. 16 is a circuit diagram showing a light-emitting diode driving apparatus that employs film capacitors.
Figure 17:
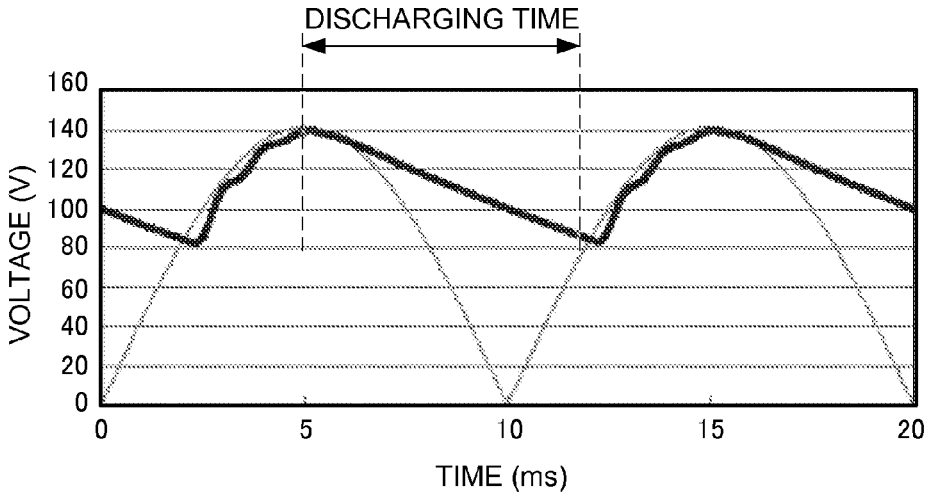
FIG. 17 shows a graph showing an input voltage waveform in the circuit shown in FIG. 16.
Figure 18:
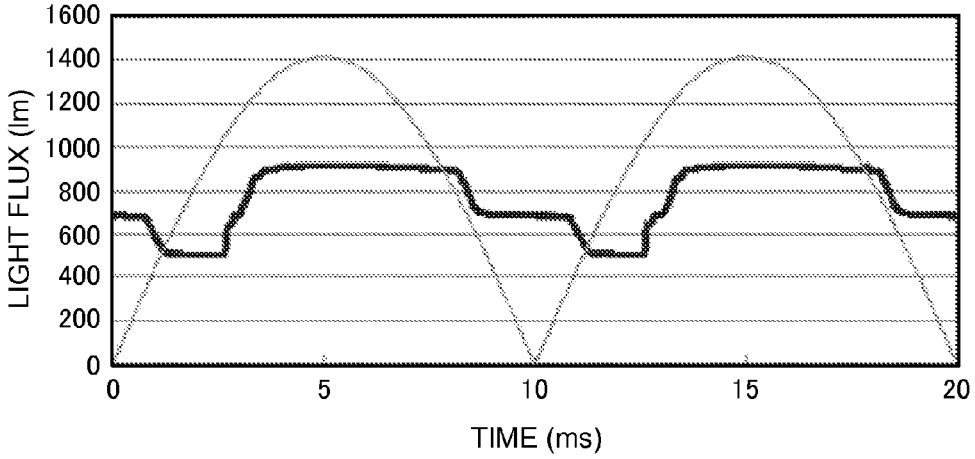
FIG. 18 is a graph showing time-variation of light flux in the circuit shown in FIG. 16.

The aforementioned operation is now described by contrast with the circuit configuration shown in FIG. 16. FIG. 17 shows an input voltage waveform smoothed by the smoothing capacitor portion in the circuit shown in FIG. 16. As shown in this Figure, when a rectified waveform (dashed lines) as an input voltage after full-wave rectification passes its peak voltage, electric charge starts spontaneously being discharged from the smoothing capacitor portion. For this reason, discharging time is long as shown by solid lines. As a result, large-capacitance capacitors are required. In addition, such capacitors are required to have high voltage resistance against the peak voltage. If LED blocks of multistage configuration as shown in FIG. 16 constantly emit light, in other words, if the first LED block 11 is not turned OFF even in the range an input voltage is low, the input voltage is required to be kept not less than the minimum forward directional voltage of an LED block having the lowest forward directional voltage (in the exemplary circuit shown FIG. 16, the minimum forward directional voltage is determined by the first LED block 11, and designed 80 V). To achieve this, the smoothing capacitor portion 73 is required to store a voltage of not less than 80 V. FIG. 18 shows a waveform of light flux by light emission of the LED blocks in this exemplary circuit shown FIG. 16 (power consumption 9.5 W, light flux 768 lm, crest factor 1.17, and power factor 58%).

In contrast to this, a smoothing circuit 50 is connected to the output side of the rectifying circuit 2 as shown in FIG. 19. In this case, a smoothing capacitor can have a low capacitance. The smoothing circuit 50 includes a smoothing capacitor 51, a charging path, and discharging path. The smoothing capacitor 51 is charged/discharged through the charging/discharging paths that are connected to the smoothing capacitor 51. The charging path includes a resistor 52 and a discharge preventing diode 53. The resistor 52 and the discharge preventing diode 53 are connected to each other in series between the rectifying circuit 2 and the smoothing capacitor 51 (positive side). Also, the discharging path includes a discharging transistor 55 (FET in the example shown in FIG. 19), a discharging diode 56, and a bypass transistor 54 (bipolar transistor in the example shown in FIG. 19). The discharging transistor 55 and a discharging diode 56 are connected to the aforementioned resistor 52 and the discharge preventing diode 53 in parallel with respect to a node CP. The bypass transistor 54 is connected to the smoothing capacitor 51 in parallel with respect to the node CP between the smoothing capacitor 51 and the aforementioned resistor 52/the discharge preventing diode 53. This bypass transistor 54 controls operation of the discharging transistor 55. For example, when an input voltage exceeds 80 V, the bypass transistor 54 is turned ON, and the discharging transistor 55 is turned OFF. When an input voltage becomes 80 V or less, the bypass transistor 54 is turned OFF, and the discharging transistor 55 is turned ON so that discharging operation starts. The base terminal of the bypass transistor 54 is connected to the input voltage side via a Zener diode and a resistor. When an input voltage exceeds 80 V and reaches the breakdown voltage of the Zener diode, a reverse current flows through the Zener diode so that a base current flows into the bypass transistor 54. As a result, the bypass transistor 54 is turned ON.

Figure 20:
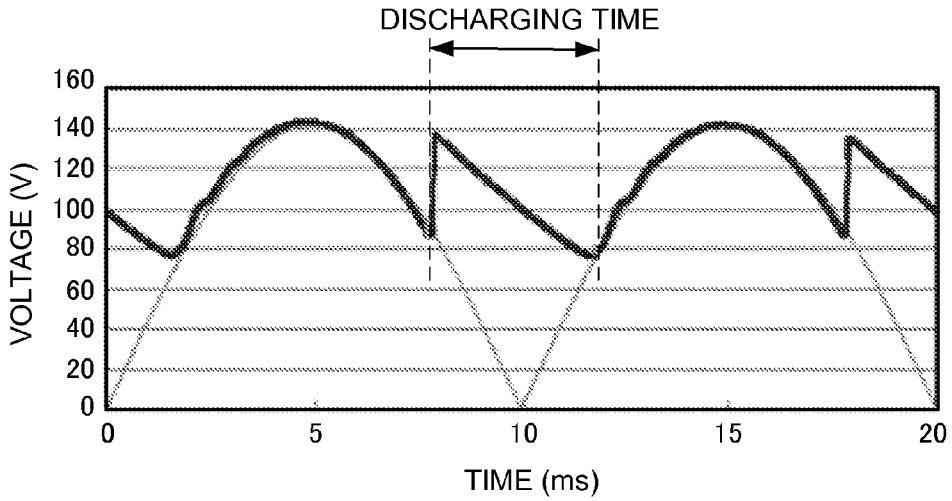
FIG. 20 shows a graph showing an input voltage waveform in the circuit shown in FIG. 19.

FIG. 20 shows a smoothed input voltage by the smoothing circuit 50. As shown in this Figure, the smoothing capacitor 51 is charged in a range from a low voltage to the peak of an input voltage through the resistor 52 and the discharge preventing diode 53, which compose the charging path. The resistor 52 serves as an inrush current relief resistor that relieves a momentary large increase in a current flowing into the smoothing capacitor 51 when power is supplied.

Even when an input voltage passes a value in proximity to its peak voltage and then decreases, the discharge preventing diode 53 prevents the smoothing capacitor 51 from discharging electric charge. As a result, the smoothing capacitor 51 does not discharge electric charge until the discharging transistor 55 is turned ON. After that, when an input voltage further decreases and reaches the predetermined capacitor discharging start voltage, the discharging transistor 55 is turned ON. As a result, the smoothing capacitor 51 discharges electric charge through the discharging path, which includes the discharging transistor 55 and the discharging diode 56. The smoothing capacitor 51 discharges electric charge for a discharging period. An input voltage increases again in the discharging period. The discharging period ends when an input voltage exceeds the forward directional voltage of an LED block having the lowest forward directional voltage (the minimum forward direction voltage). Thus, either of the LED blocks (the first LED block 11 in the exemplary circuit of FIG. 19) constantly emits light. Therefore, it is possible to suppress the stroboscope effect.

According to this smoothing circuit 50, the capacitor discharging start voltage can be lower than the peak value (141V) of input voltage as in the case of FIG. 16. Accordingly, the discharging period can be short as shown in FIGS. 17 and 20. Since the discharging period can be short, the capacitance of the smoothing capacitor can be small. The reason is that a short charging period leads reduction of a capacitance required of the smoothing capacitor. Accordingly, a small-capacitance capacitor such as film capacitor can be employed. In addition, it is possible to reduce the number of required capacitors, and to reduce the space occupied by required capacitors. Therefore, it is possible to provide a small LED driving apparatus.

Figure 21:
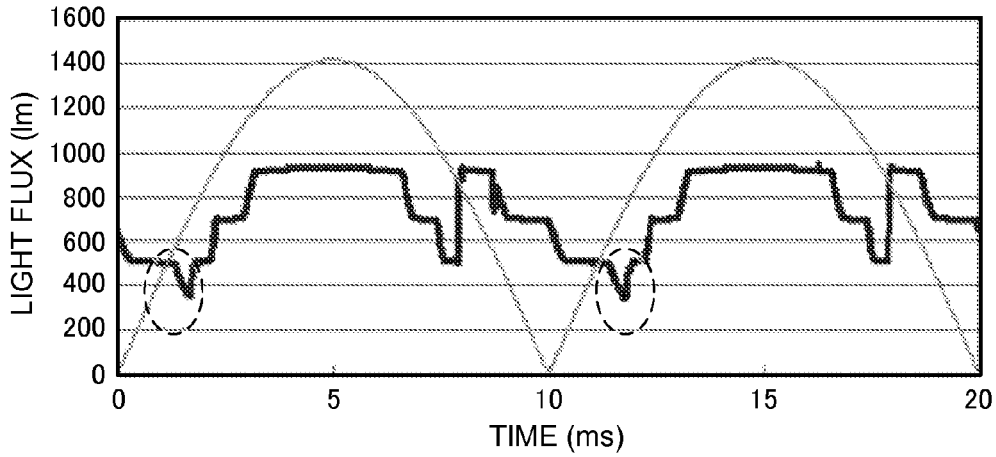
FIG. 21 is a graph showing time-variation of light flux in the circuit shown in FIG. 19.

The capacitor discharging start voltage is adjusted to the same voltage as the minimum forward directional voltage or higher. According to this adjustment, any of the LED blocks constantly emits light. Therefore, it is possible to suppress the stroboscope effect. In the exemplary circuit of FIG. 19, as shown in FIG. 20, the capacitor discharging start voltage is determined so that the smoothing capacitor starts discharging electric discharge not at a point immediately after the peak voltage of an input voltage but at a point in that an input voltage becomes lower than a required voltage (80 V) for light emission of the first LED block. The LED light flux waveform obtained by the LED driving apparatus can be shown in FIG. 21. Although a driving voltage decreases to a value lower than 80 V in a part of a cyclic period (valley part in FIG. 21), this part is very short. It cannot be confirmed that the stroboscope effect is visually conceivable. The LED driving apparatus shown in FIG. 19 has power consumption 9.5 W (LED electric power 8 W), power supply efficiency 84%, power factor 82%, average light flux 745 lm, light emission efficiency 78 lm/W, LED operation efficiency 55%, and crest factor 1.23. The light flux of LED driving apparatus shown in FIG. 19 is substantially equal to the LED driving apparatus shown in FIG. 16. Although the crest factor of the LED driving apparatus shown in FIG. 19 is slightly smaller the LED driving apparatus shown in FIG. 16, a capacitance of the smoothing capacitor required of the LED driving apparatus shown in FIG. 19 is half of the LED driving apparatus shown in FIG. 16. Therefore, the LED driving apparatus shown in FIG. 19 has advantages in manufacturing cost, installation space, and the like.

(Lighting Apparatus)

The aforementioned light-emitting diode driving apparatus includes LED devices. The LED devices and the driving circuit for driving the LED devices can be mounted on a common circuit board. This light-emitting diode driving apparatus can be used as a lighting apparatus driven by AC commercial power for home use.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2009-166184 filed in Japan on Jul. 14, 2009, and No. 2009-260505 file in Japan on Nov. 13, 2010, the contents of which are incorporated herein by references.

INDUSTRIAL APPLICABILITY

A light-emitting diode driving apparatus and a light-emitting diode driving operation controlling method according to the present invention can be suitably applied to a lighting apparatus, an LED display, a laser display, and the like. A light-emitting diode driving apparatus and a light-emitting diode driving operation controlling method according to the present invention can suitably drive power LEDs and semiconductor laser diodes.

What is claimed is:

1. A light-emitting diode driving apparatus comprising:

a rectifying circuit connected to an AC power supply and rectifies an AC voltage of the AC power supply to provide a pulsating current voltage;

first, second and third LED blocks each of which includes a plurality of light-emitting diodes, the first, second and third LED blocks being connected to an output side of said rectifying circuit in series;

a first switching portion that switches ON or OFF a first bypass path for bypassing said second LED block based on a flowing current amount in said first LED block, a second switching portion that switches ON or OFF a second bypass path for bypassing said third LED block based on a flowing current amount in said first and second LED blocks, and a current restricting portion that is connected to said third LED block in series.

2. The light-emitting diode driving apparatus according to claim 1, wherein said first switching portion includes a first current controlling portion that is connected to said second LED block in parallel, and restricts the flowing current amount in said first LED block, a first current detecting/controlling portion that controls the restriction amount on the flowing current in said first LED block by said first current controlling portion, and a first current detecting portion that is connected to said first LED block in series and detects the flowing current amount in said first LED block, wherein said second switching portion includes a second current controlling portion that is connected to said third LED block in parallel, and restricts the flowing current amount in said first and second LED blocks, a second current detecting/controlling portion that controls the restriction amount on the flowing current in said first and second LED blocks by said second current controlling portion, and a second current detecting portion that is connected to said second LED block in series and detects the flowing current amount in said second LED block.

3. The light-emitting diode driving apparatus according to claim 1 further comprising a capacitor that is connected between the ground and an output side of said rectifying circuit.

4. The light-emitting diode driving apparatus according to claim 1, wherein said first switching portion comprises a first current controlling portion that is connected to said second LED block in parallel, and restricts the flowing current amount in said first LED block, wherein said second switching portion comprises a second current controlling portion that is connected to said third LED block in parallel, and restricts the flowing current amount in said first and second LED blocks, and wherein a current detecting/controlling portion controls the restriction amount on the flowing current in said first, second and third LED blocks by said first current controlling portion and second current controlling portion.

5. The light-emitting diode driving apparatus according to claim 4, wherein said current detecting/controlling portion comprises:

a first current detecting/controlling portion that controls the restriction amount on the flowing current in said first LED block by said first current controlling portion, a second current detecting/controlling portion that controls the restriction amount on the flowing current in said first and second LED blocks by said second current controlling portion, and a third current detecting/controlling portion that controls the restriction amount on the flowing current in said first, second and third LED blocks by said third current controlling portion.

6. The light-emitting diode driving apparatus according to claim 1, further comprising a third current controlling portion that is connected to said current restricting portion in parallel, and restricts a flowing current amount in said first, second and third LED blocks.

7. A light-emitting diode driving apparatus comprising:

a rectifying circuit connected to an AC power supply and rectifies an AC voltage of the AC power supply to provide a pulsating current voltage;

a first LED block that includes a plurality of light-emitting diodes and is connected to an output side of said rectifying circuit in series;

a second LED block that includes a plurality of light-emitting diodes and is connected to said first LED block in series;

a third LED block that includes a plurality of light-emitting diodes and is connected to said second LED block in series;

a current restricting portion that is connected to said third LED block in series, a first current controlling portion that is connected to said second LED block in parallel, and restricts a flowing current amount in said first LED block, a second current controlling portion that is connected to said third LED block in parallel, and restricts a flowing current amount in said first and second LED blocks, a third current controlling portion that is connected to said current restricting portion in parallel, and restricts a flowing current amount in said first, second and third LED blocks, a first current detecting/controlling portion that controls the restriction amount on the flowing current in said first LED block by said first current controlling portion, a second current detecting/controlling portion that controls the restriction amount on the flowing current in said first and second LED blocks by said second current controlling portion, and a third current detecting/controlling portion that controls the restriction amount on the flowing current in said first, second and third LED blocks by said third current controlling portion.

8. The light-emitting diode driving apparatus according to claim 7, wherein the restriction amount on the flowing current in said first LED block by said first current controlling portion is smaller than the restriction amount on the flowing current in said first and second LED blocks by said second current controlling portion, and the restriction amount on the flowing current in said first and second LED blocks by said second current controlling portion is smaller than the restriction amount on the flowing current in said first, second and third LED blocks by said third current controlling portion.

9. The light-emitting diode driving apparatus according to claim 7 further comprising a current detecting portion that is connected between said current restricting portion and the ground, wherein said first, second and third current detecting/controlling portions control the restriction amounts on the flowing currents in said first, second and third LED blocks based on a flowing current amount in said current detecting portion.

10. A light-emitting diode driving operation controlling method comprising the steps of:

providing a pulsating current voltage that is obtained by rectifying an AC voltage of an AC power supply;

applying the pulsating current voltage to first, second and third LED blocks each of which includes a plurality of light-emitting diodes that are connected to each other in series, the first, second and third LED blocks being connected to each other in series;

switching ON or OFF a first bypass path based on a flowing current amount in said first LED block by a first current controlling portion so that the first bypass path is turned ON when this flowing current amount is not higher than a predetermined value and the first bypass path is turned OFF when this flowing current amount exceeds this predetermined value, the first current controlling portion being configured to switch ON or OFF the first bypass path connected to said second LED block in parallel for bypassing said second LED block; and switching ON or OFF a second bypass path based on a flowing current amount in said second LED block by a second current controlling portion so that the second bypass path is turned ON when this flowing current amount is not higher than a predetermined value and the second bypass path is turned OFF when this flowing current amount exceeds this predetermined value, the second current controlling portion being configured to switch ON or OFF the second bypass path connected to said third LED block in parallel for bypassing the third LED block if said first bypass path is turned OFF so that a current can flow through said second LED block, further comprising a step of switching ON or OFF a third bypass path based on a flowing current amount in said third LED block by a third current controlling portion so that the third bypass path is turned ON when this flowing current amount is not higher than a predetermined value and the third bypass path is turned OFF when this flowing current amount exceeds this predetermined value, the third current controlling portion being configured to switch ON or OFF the third bypass path connected in parallel to a current restricting portion connected in series to said third LED block for bypassing the current restricting portion if said second bypass path is turned OFF so that a current can flow through said third LED block.

* * * * *